US010185255B2

(12) United States Patent
Kochi et al.

(10) Patent No.: US 10,185,255 B2
(45) **Date of Patent: *Jan. 22, 2019**

(54) IMAGE FORMING APPARATUS AND IMAGE FORMING METHOD FOR CONTROLLING A SECONDARY TRANSFER BIAS ACCORDING TO RECORDING SHEET TYPE

(71) Applicant: Ricoh Company, Ltd., Tokyo (JP)

(72) Inventors: Naoto Kochi, Tokyo (JP); Hirokazu Ishii, Tokyo (JP); Seiichi Kogure, Kanagawa (JP); Naohiro Kumagai, Kanagawa (JP); Kenji Sugiura, Kanagawa (JP); Shinya Tanaka, Kanagawa (JP); Hiroki Nakamatsu, Kanagawa (JP); Yuuji Wada, Kanagawa (JP); Junpei Fujita, Kanagawa (JP); Takahiro Suzuki, Tokyo (JP); Kazuki Yogosawa, Kanagawa (JP); Atsushi Nagata, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/432,392

(22) Filed: Feb. 14, 2017

(65) Prior Publication Data

US 2017/0235257 A1 Aug. 17, 2017

(30) Foreign Application Priority Data

Feb. 15, 2016 (JP) ..... 2016-026314
Mar. 18, 2016 (JP) ..... 2016-054880
(Continued)

(51) Int. Cl.
*G03G 15/16* (2006.01)
*G03G 5/00* (2006.01)
*G03G 5/147* (2006.01)

(52) U.S. Cl.
CPC ..... *G03G 15/1675* (2013.01); *G03G 5/005* (2013.01); *G03G 5/147* (2013.01)

(58) Field of Classification Search
CPC ..... G03G 15/1665; G03G 15/1675; G03G 15/1685; G03G 2215/1623
(Continued)

(56) References Cited

U.S. PATENT DOCUMENTS 5,930,573 A 7/1999 Miyamoto et al.
6,188,862 B1 2/2001 Ishii
(Continued)

FOREIGN PATENT DOCUMENTS

JP 2002-169383 6/2002
JP 2006-259571 9/2006
(Continued)

*Primary Examiner* — Sandra Brase
(74) *Attorney, Agent, or Firm* — Oblon, McClelland, Maier & Neustadt, L.L.P.

(57) ABSTRACT

An image forming apparatus includes an image bearer to bear a toner image, a nip forming member contacting the image bearer to form a transfer nip, and a transfer power source. The transfer bias has a transfer peak value to electrostatically move toner from the image bearer to the recording sheet and an opposite-peak value to electrostatically move less toner from the image bearer to the recording sheet than the transfer peak value. An opposite-peak duty of the transfer bias is less than 50%. The opposite-peak duty is tr/T×100% where T is one cycle of the transfer bias and tr is a time period during which the transfer bias is on a side of the opposite-peak value relative to an offset voltage of the transfer bias in the one cycle T.

19 Claims, 15 Drawing Sheets

(30) Foreign Application Priority Data

Sep. 12, 2016 (JP) ..... 2016-177328
Nov. 14, 2016 (JP) ..... 2016-221685

(58) Field of Classification Search
USPC ..... 399/66, 308, 313, 314, 296
See application file for complete search history.

(56) References Cited

U.S. PATENT DOCUMENTS 8,000,640 B2 * 8/2011 Tabata ..... G03G 15/169 399/296
8,068,768 B2 * 11/2011 Adachi ..... G03G 15/0291 399/168
2003/0219296 A1 11/2003 Kabata et al.
2011/0158690 A1 6/2011 Mimbu et al.
2011/0229168 A1 9/2011 Shiraishi et al.
2012/0082488 A1 * 4/2012 Kubo ..... G03G 15/162 399/302
2012/0230715 A1 9/2012 Ogino et al.
2012/0237234 A1 9/2012 Sugimoto et al.
2012/0315056 A1 12/2012 Shimizu et al.
2013/0004212 A1 * 1/2013 Kubo ..... G03G 15/162 399/302
2013/0142531 A1 * 6/2013 Sugimoto ..... G03G 15/1675 399/66
2013/0308968 A1 * 11/2013 Tanaka ..... G03G 15/1675 399/44
2014/0010562 A1 1/2014 Tanaka et al.
2014/0079418 A1 3/2014 Tanaka et al.
2016/0109832 A1 4/2016 Ohsugi et al.
2016/0274504 A1 9/2016 Wada et al.
2017/0235258 A1 * 8/2017 Wada ..... G03G 15/1675 399/66

FOREIGN PATENT DOCUMENTS

JP 2007-249131 9/2007
JP 2013-015816 1/2013
JP 2013-127592 6/2013
JP 2014-010383 1/2014
JP 2014-077981 5/2014
JP 2014-228574 12/2014

* cited by examiner

IMAGE FORMING APPARATUS AND IMAGE FORMING METHOD FOR CONTROLLING A SECONDARY TRANSFER BIAS ACCORDING TO RECORDING SHEET TYPE

CROSS-REFERENCE TO RELATED APPLICATIONS

This patent application is based on and claims priority pursuant to 35 U.S.C. § 119(a) to Japanese Patent Application No. 2016-026314, filed on Feb. 15, 2016, Japanese Patent Application No. 2016-054880, filed on Mar. 18, 2016, Japanese Patent Application No. 2016-177328, filed on Sep. 12, 2016, and Japanese Patent Application No. 2016-221685, filed on Nov. 14, 2016 in the Japan Patent Office, the entire disclosures of which are hereby incorporated by reference herein.

BACKGROUND

Technical field

Embodiments of the present invention generally relates to an image forming apparatus and an image forming method.

Related Art

There has been known an image forming apparatus that outputs a transfer bias (transfer current) in which a direct current (DC) voltage and an alternating current (AC) voltage are superimposed on each other to a transfer nip formed by an image bearer contacting a nip forming member, thereby transferring a toner image from a surface of the image bearer onto a recording sheet in the transfer nip.

In an image forming apparatus, for example, a secondary-transfer power source outputs a secondary-transfer bias as intruder current to a secondary-transfer nip formed by a nip forming roller as a nip forming member contacting an intermediate transfer belt as the image bearer. The secondary-transfer power source outputs a secondary-transfer bias including only the DC voltage to transfer a toner image from the intermediate transfer belt onto a recording sheet without unevenness on the surface thereof. However, the secondary-transfer power source outputs a superimposed voltage, in which the AC voltage is superimposed on the DC voltage, as the secondary-transfer bias to form an alternating electrical field within the secondary-transfer nip to transfer the toner image from the intermediate transfer belt onto a recording sheet, with an uneven surface, such as Japan paper. Such a generated alternating electrical field reciprocates toner between the surface of the intermediate transfer belt and the recesses on the surface of the recording sheet in the secondary-transfer nip, thereby secondarily transferring toner onto the recesses on the surface of the recording sheet, in a successful manner.

SUMMARY

In an aspect of this disclosure, there is provided an improved image forming apparatus that includes an image bearer to bear a toner image, a nip forming member contacting the image bearer to form a transfer nip, and a transfer power source. The image bearer has a micro-rubber hardness of less than 100. The transfer power source outputs a transfer bias including a superimposed voltage, in which an alternating current (AC) voltage is superimposed on a direct current (DC) voltage, to transfer the toner image borne on the image bearer onto a recording sheet disposed between the image bearer and the nip forming member. The transfer bias has a transfer peak value to electrostatically move toner from the image bearer to the recording sheet and an opposite-peak value to electrostatically move less toner from the mage beater to the recording sheet than the transfer peak value. An opposite-peak duty of the transfer bias is less than 50%. The opposite-peak duty is tr/T×100% where T is one cycle of the transfer bias and tr is a time period during which the transfer bias is on a side of the opposite-peak value relative to an offset voltage of the transfer bias in the one cycle T.

In another aspect of this disclosure, there is provided on improved image forming method including transferring a toner image from the image bearer having a micro-hardness of less than 100 onto a recording sheet by a transfer bias. The transfer bias has a transfer peak value to electrostatically move toner from the image bearer to the recording sheet and an opposite-peak value to electrostatically move less toner from the mage bearer to the recording sheet than the transfer peak value. An opposite-peak duty of the transfer bias is less than 50%. The opposite-peak duty is tr/T×100% where T is one cycle of the transfer bias and tr is a time period during which the transfer bias is on a side of the opposite-peak value relative to an offset voltage of the transfer bias in the one cycle T.

BRIEF DESCRIPTION OF THE DRAWINGS

The aforementioned and other aspects features, and advantages of the present disclosure will be better understood by reference to the following detailed description when considered in connection with the accompanying drawings, wherein.

Figure 1:
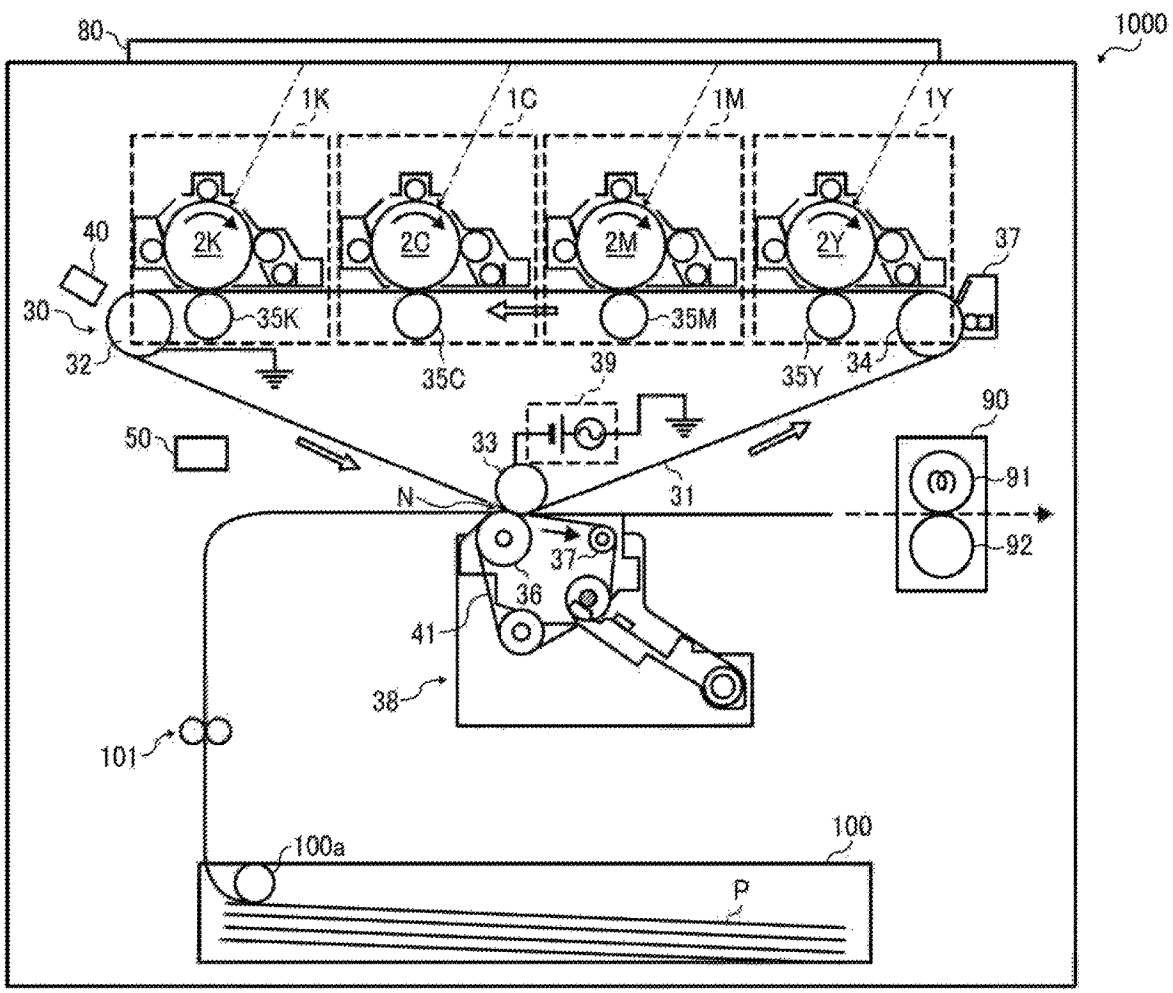
FIG. 1 is a schematic view of a printer as an example of an image forming apparatus, according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

The following describes an electrophotographic color printer as an example of an image forming apparatus according to a first embodiment of the present disclosure. The various aspects of the present disclosure adapt to, not limited to a printer (an image forming apparatus), other types of image forming apparatuses, such as multicolor copiers, fax machines, and multifunction peripherals having the capabilities of the multicolor copiers and the fax machines.

The present inventors have found that a configuration, in which the alternating electrical field is generated to reciprocate toner in a transfer nip to transfer the toner into recesses of a recording sheet, has the following failures when the high-speed printing is attempted to respond to a demand for business users. Transferring a sufficient amount of toner onto recesses of a recording sheet having an uneven surface is difficult and many white spots occurs in an image.

With reference to FIG. 1, a description is provided of an electrophotographic color printer as an example of an image forming apparatus 1000 according to an embodiment of the present disclosure. The various aspects of the present specification can adapt to, not limited to a printer (an image forming apparatus), other types of image forming apparatuses such as multicolor copiers, fax machines, scanners, and multifunction peripherals having these capabilities.

A basic configuration of the image forming apparatus 1000 is described below. FIG. 1 is a schematic view of the image forming apparatus 1000. As illustrated in FIG. 1, the image forming apparatus 1000 includes four toner image forming units 1Y, 1M, 1C, and 1K for forming toner images, one for each of the colors yellow, magenta, cyan, and black, respectively. It is to be noted that the suffixes Y, M, C, and K denote colors yellow, magenta, cyan, and black, respectively. To simplify the description, the suffixes Y, M, C, and K indicating colors may be omitted herein, unless differentiation of colors is described. The image forming apparatus 1000 also includes a transfer unit an optical writing unit 80, a fixing device 90, a sheet tray 100, and a pair of registration rollers 101.

Figure 2:
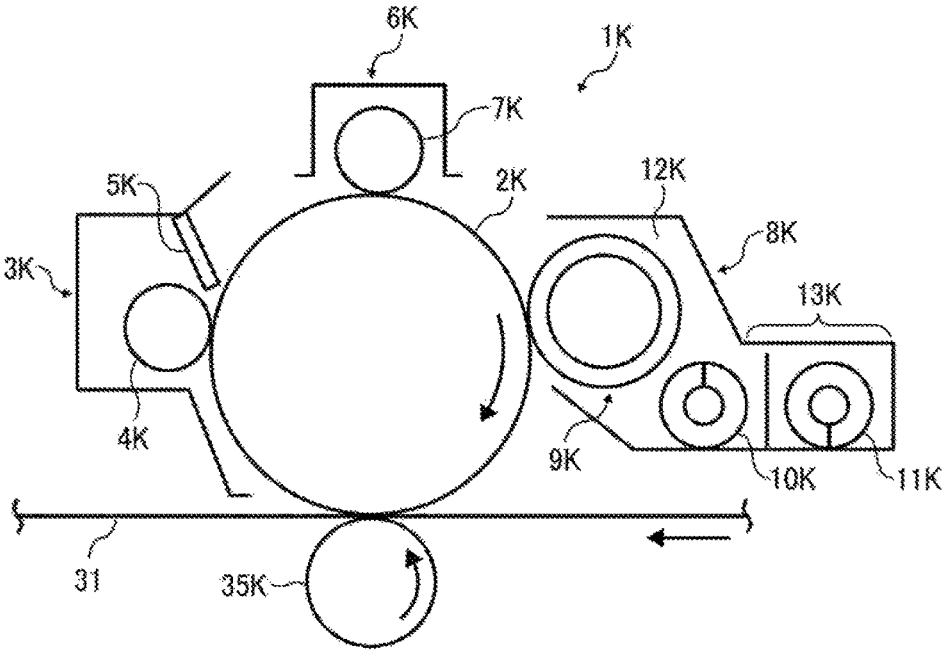
FIG. 2 is a schematic view of a toner image forming unit for the color black as a representative example of image forming units employed in the image forming apparatus of FIG. 1.

The image forming units 1Y, 1M, 1C, and 1K all have the same configuration, differing in the color of toner employed. The image forming units 1Y, 1M, 1C, and 1K are replaced upon reaching their product life cycles. FIG. 2 is a schematic diagram illustrating the toner image forming unit 1K. The toner image forming unit 1K include a photoconductor 2K serving as a latent image bearer that bears an image. The photoconductor 2K is surrounded by various pieces of imaging equipment, such as a charging device 6K, a developing device 8K, a photoconductor cleaner 3K, and a charge remover. These devices are held by a common holder so that they are detachably attachable and replaced at the same time.

The photoconductor 2K as a first image bearer includes a drum-shaped base on which an organic photosensitive layer is disposed. The photoconductor 2K is rotated in a clockwise direction by a driving device. The charging device 6K includes a charging roller 7K to which a charging bias is applied. The charging roller 7K contacts or is disposed in proximity to the photoconductor 2K to generate electrical discharge between the charging roller 7K and the photoconductor 2K, thereby charging uniformly the surface of the photoconductor 2K. According to the present embodiment, the photoconductor 2K is uniformly charged negatively, which is the same polarity as that of normally-charged toner. As a charging bias, an alternating current (AC) voltage superimposed on a direct current (DC) voltage is employed. The charging roller 7K includes a metal cored bar coated with a conductive elastic layer made of a conductive elastic material. According to the present embodiment, the photoconductor 2K is charged by the charging roller contacting the photoconductor 2K or disposed near the photoconductor 2K. Alternatively, a corona charger may be employed.

The uniformly charged surface of the photoconductor 2K is scanned by laser light projected from the optical writing unit 80, thereby forming an electrostatic latent image for black on the surface of the photoconductor 2K. The electrostatic latent image for black on the photoconductor 2K is developed with black toner by the developing device 8K. Accordingly, a visible image, also known as a toner image of black, is formed on the photoconductor 2K. As will be described later in detail, the toner image is transferred primarily onto an intermediate transfer belt 31 in a process known as a primary transfer process.

The photoconductor cleaner 3K removes residual toner remaining on the surface of the photoconductor 2K after the primary transfer process, that is, after the photoconductor 2K passes through a primary transfer nip. The photoconductor cleaner 3K includes a brush roller 4K and a cleaning blade 5K. The cleaning blade 5K is cantilevered, that is, one end of the cleaning blade 5K is fixed to the housing of the photoconductor cleaner 3K, and its free end contacts the surface of the photoconductor 2K. The brush roller 4K rotates and brushes off the residual toner from the surface of the photoconductor 2K while the cleaning blade 5K removes the residual toner by scraping.

The charge remover removes residual charge remaining on the photoconductor 2K after the surface thereof is cleaned by the photoconductor cleaner 3K. The surface of the photoconductor 2K is initialized in preparation for the subsequent imaging cycle.

The developing device 8K as a developer bearer includes a developing portion 12K and a developer conveyor 13K. The developing portion 12K includes a developing roller 9K inside thereof. The developer conveyor 13K stirs a black developing agent and transports the black developing agent. The developer conveyor 13K includes a first chamber equipped with a first screw 10K and a second chamber equipped with a second screw 11K. The first screw 10K and the second screw 11K are each constituted of a rotatable shaft and helical flighting wrapped around the circumferential surface of the shaft. Each end of the shaft of the first screw 10 and the second screw 11K in the axial direction of the shaft is rotatably held by shaft bearings.

The first chamber with the first screw 10K and the second chamber with the second screw 11K are separated by a wall, but each end of the wall in the axial direction of the screw shaft has a connecting hole through which the first chamber and the second chamber communicate. The first screw 10K mixes the developing agent by rotating the helical flighting and carries the developing agent from the distal end to the proximal end of the screw in the direction perpendicular to the drawing plane while rotating. The first screw 10K is disposed parallel to and facing the developing roller 9K. The black developing agent is delivered along the axial (shaft) direction of the developing roller 9K. The first screw 10K supplies the developing agent to the surface of the developing roller 9K along the direction of the shaft line of the developing roller 9K.

The developing agent transported near the proximal end of the first screw 10K passes through the connecting hole in the wall near the proximal side and enters the second chamber. Subsequently, the developing agent is carried by the helical flighting of the second screw 11K. As the second screw 11K rotates, the developing agent is delivered from the proximal end to the distal end in FIG. 2 while being mixed in the direction of rotation.

In the second chamber, a tone density sensor for detecting the density of the toner in the developing agent is disposed at the bottom of a casing of the chamber. As the toner density sensor, a magnetic permeability detector is employed. There is a correlation between the toner density and the magnetic permeability of the developing agent consisting of toner panicles and magnetic carrier particles. Therefore, the magnetic permeability detector can detect the density of the toner.

Although not illustrated, the image forming apparatus 1000 includes toner supply devices to supply independently toners of yellow, magenta, cyan, and black to the second chamber of the respective developing devices 8Y, 8M, 8C and 8K. The controller of the image forming apparatus includes a Random Access Memory (RAM) to store a target output voltage Vtref for output voltages provided by the toner density sensors for yellow, magenta, cyan, and black. If the difference between the output voltages provided by the toner density sensors for yellow magenta, cyan, and black, and Vtref for each color exceeds a predetermined value, the toner supply devices are driven for a predetermined time period corresponding to the difference to supply toner. Accordingly, the respective color of toner is supplied to the second chamber of the developing device 8, so that the toner density of the developer for each color maintains within a predetermined range.

The developing roller 9K in the developing portion 12K faces the first screw 10K as well as the photoconductor 2K through an opening formed in the casing of the developing device 8K. The developing roller 9K includes a cylindrical developing sleeve made of a non-magnetic pipe that is rotated, and a magnetic roller disposed inside the developing sleeve. The magnetic roller is fixed so as not to rotate together with the developing sleeve. The black developing agent supplied from the first screw 10K is carried on the surface of the developing sleeve due to the magnetic force of the magnetic roller. As the developing sleeve rotates, the developing agent is transported to a developing area facing the photoconductor 2K.

The developing sleeve is supplied with a developing bias having the same polarity as the polarity of toner. An absolute value of the developing bias is greater than the potential of the electrostatic latent image on the photoconductor 2K, but less than the charge potential of the uniformly charged photoconductor 2K. With this configuration, a developing potential that causes the tone on the developing sleeve to move electrostatically to the electrostatic latent image on the photoconductor 2K acts between the developing sleeve and the electrostatic latent image on the photoconductor 2K. A background potential acts between the developing sleeve and a background portion (non-image formation area) of the photoconductor 2K, causing the toner on the developing sleeve to move to the sleeve surface. Due to the background potential and the non-developing potential, the toner on the developing sleeve moves selectively to the electrostatic latent image formed on the photoconductor 2K, thereby forming a visible image, known as a toner image.

Similar to the toner image forming unit 1K, toner images of yellow, magenta, and cyan are formed on the photoconductors 2Y, 2M, and 2C of the toner image forming units 1Y, 1M and 1C, respectively. The optical writing unit 80 for writing a latent image on the photoconductors 2 is disposed above the toner image forming units 1Y, 1M, 1C, and 1K.

Based on image information provided by an external device such as a personal computer (PC), the optical writing unit 80 illuminates the photoconductors 2Y, 2M, 2C and 2K with the laser light projected from a laser diode of the optical writing unit 80. Accordingly, the electrostatic latent images of yellow, magenta, cyan, and black are formed on the photoconductors 2Y, 2M, 2C, and 2K respectively. The optical writing unit 80 includes a polygon mirror, a plurality of optical lenses, and mirrors. The light beam projected from the laser diode serving as a light source is deflected in a main scanning direction by the polygon mirror rotated by a polygon motor. The deflected light, then, strikes the optical lenses and mirrors, thereby scanning the photoconductor 2Y. Alternatively, the optical writing unit 80 may employ a light source using an LED array including a plurality of LEDs that projects light.

Referring back to FIG. 2, a description is provided of the transfer unit 30. The transfer unit 30 is disposed below the toner image forming units 1Y, 1M, 1C, and 1K. The transfer unit 30 includes the intermediate transfer belt 31 serving as an image bearing member formed into an endless loop and rotated in the counterclockwise direction. The transfer unit 30 also includes a plurality of rollers: a drive roller 32, a secondary-transfer first roller 33, a cleaning auxiliary roller 34, and four primary transfer rollers 35Y, 35M, 35C, and 35K (which may be referred to collectively as primary transfer rollers 35). The transfer unit 30 further includes a belt cleaning device 37 and a density sensor 40.

The intermediate transfer belt 31 as a second image bearer is entrained around and stretched taut between the plurality of rollers, i.e., the drive roller 32, the secondary-transfer first roller 33, the cleaning auxiliary roller 34, and the four primary transfer rollers 35Y, 35M, 35C, and 35K. The drive roller 32 is rotated in the counterclockwise direction by a motor or the like, and rotation of the drive roller 32 enables the intermediate transfer belt 31 to rotate in the same direction.

The intermediate transfer belt 31 is interposed between the photoconductors 2Y, 2M, 2C, and 2K, and the primary transfer rollers 35Y, 35M, 35C, and 35K. Accordingly, primary transfer nips are formed between the outer peripheral surface or the image bearing surface of the intermediate transfer belt 31 and the photoconductors 2Y, 2M, 2C, and 2K that contact the intermediate transfer belt 31. A primary transfer power source applies a primary transfer bias to the primary transfer rollers 35Y, 35M, 35C, and 35K. Accordingly, a transfer electric field is formed between the primary transfer rollers 35Y, 35M, 35C, and 35K, and the toner images of yellow, magenta, cyan, and black formed on the photoconductors 2Y, 2M, 2C, and 2K. The yellow toner image formed on the photoconductor 2Y enters the primary transfer nip for yellow as the photoconductor 2Y rotates. Subsequently, the yellow toner image is primarily transferred from the photoconductor 2Y to the intermediate transfer belt 31 by the transfer electrical field and the nip pressure. The intermediate transfer belt 31, on which the yellow toner image has been transferred, sequentially passes through the primary transfer nips of magenta, cyan, and black. Subsequently, the toner images on the photoconductors 2M, 2C and 2K are superimposed on the yellow toner image that has been transferred on the intermediate transfer belt 31, one atop the other, thereby forming a composite toner image on the intermediate transfer belt 31 in the primary transfer process. Accordingly, the composite toner image, in which the toner images of yellow, magenta, cyan, and black are superimposed one atop the other, is formed on the surface of the intermediate transfer belt 31. According to the present embodiment described above, a roller-type transfer device (here, the primary transfer rollers 35) is used as a primary transfer device. Alternatively, a transfer charger or a brush-type transfer device may be employed as a primary transfer device.

A sheet conveyor unit 38, disposed substantially below the transfer unit 30, includes a secondary-transfer second roller 36 disposed opposite to the secondary-transfer first roller 33 via the intermediate transfer belt 31 and a sheet conveyor belt 41 (generally referred to as a secondly transfer belt or a secondary transfer member). As illustrated in FIG. 1, the sheet conveyor belt 41 is formed into an endless loop and looped around a plurality of rollers including the secondary-transfer second roller 36. As the secondary-transfer second roller 36 is driven to rotate, the sheet conveyor belt 41 is rotated in the clockwise direction in FIG. 1. The secondary-transfer second roller 36 contacts, via the sheet conveyor belt 41, a portion of the front surface or the image bearing surface of the intermediate transfer belt 31 looped around the secondary-transfer first roller 33, thereby forming a secondary transfer nip N therebetween. That is, the intermediate transfer belt 31 and the sheet conveyor belt 41 are interposed between the secondary-transfer first roller 33 of the transfer unit 30 and the secondary-transfer second roller 36 of the sheet conveyor unit 38. Accordingly, the outer peripheral surface or the image bearing surface of the intermediate transfer belt 31 contacts the outer peripheral surface of the sheet conveyor belt 41 serving as the nip forming member, thereby forming the secondary transfer nip. The secondary-transfer second roller 36 disposed inside the loop of the sheet conveyor belt 41 is grounded; whereas, a secondary transfer bias is applied to the secondary-transfer first roller 33 disposed inside loop of the intermediate transfer belt 31 by a secondary-transfer power source 39. With this configuration, a secondary transfer electrical field is formed between the secondary-transfer first roller 33 and the secondary-transfer second roller 36 so that the toner having a negative polarity is transferred electrostatically from the secondary-transfer first roller side to the secondary-transfer second roller side. Alternatively, instead of the sheet conveyor belt 41, a secondary transfer roller may be employed as the nip forming device to contact directly the intermediate transfer belt 31.

As illustrated in FIG. 1, the sheet tray 500 storing a sheaf of recording sheets P as a recording medium is disposed below the transfer unit. The sheet tray 100 equipped with a feed roller 100*a* that contacts the top sheet of the sheaf of recording sheets P. As the feed roller 100*a* is rotated at a predetermined speed, the feed roller 100*a* picks up and sends the top sheet of the recording sheets P to a sheet delivery path. Substantially near the end of the sheet delivery path, the pair of registration rollers 101 is disposed. The pair of registration rollers 101 stops rotating temporarily as soon as the recording sheet P fed from the sheet tray 100 is interposed between the pair of registration rollers 101. The pair of registration rollers 101 starts to rotate again to feed the recording sheet P to the secondary transfer nip N in appropriate tuning such that the recording sheet P is aligned with the composite toner image formed on the intermediate transfer belt 31 at the secondary transfer nip. In the secondary transfer nip N, the recording sheet P tightly contacts the composite toner image on the intermediate transfer belt 33, and the composite toner image is secondarily transferred onto the recording sheet P by the secondary transfer electric field and the nip pressure applied thereto, thereby forming a full-color toner image on the recording sheet P. The recording sheet P, on which the full-color toner image is formed, passes through the secondary transfer nip N and separates from the intermediate transfer belt 31 due to self-stripping. Furthermore, the curvature of a separation roller 42, around which the sheet conveyor belt 41 is looped, enables the recording sheet P to separate from the sheet conveyor belt 41.

According to the present embodiment, the sheet conveyor belt 41 as the nip forming device contacts the intermediate transfer belt 31 to form the secondary transfer nip N. Alternatively, a nip forming roller as the nip forming device may contact the intermediate transfer belt 31 to form the secondary transfer nip.

After the intermediate transfer belt 31 passes through the secondary transfer nip N, residual toner not having been transferred onto the recording sheet P remains on the intermediate transfer belt 33. The residual toner is removed from the intermediate transfer belt 31 by the belt cleaning device 37 which contacts the surface of the intermediate transfer belt 31. The cleaning auxiliary roller 34 disposed inside the loop formed by the intermediate transfer belt 31 supports the cleaning operation performed by the belt cleaning device 37.

As illustrated in FIG. 1, the density sensor 40 is disposed outside the loop formed by the intermediate transfer belt 31. More specifically, the density sensor 40 faces a portion of the intermediate transfer belt 31 looped around the drive roller 32 with a predetermined gap between the density sensor 40 and the intermediate transfer belt 31. An amount of toner adhered to the toner image per unit area (image density) primarily transferred onto the intermediate transfer belt 31 is measured when the toner image comes to the position opposite to the density sensor 40.

The fixing device is disposed downstream from the secondary transfer nip N in the direction of conveyance of the recording sheet P. The fixing device 90 includes a fixing roller 91 and a pressing roller 92. The fixing roller 91 includes a heat source such as a halogen lamp inside the fixing roller 92. While rotating, the pressing roller 92 pressingly contacts the fixing roller 91, thereby forming a heated area called a fixing nip therebetween. The recording sheet P bearing an unfixed toner image on the surface thereof is delivered to the fixing device 90 and interposed between the fixing roller 91 and the pressing roller 92 in the fixing device 90. Under heat and pressure, the toner adhered to the toner image is softened and fixed to the recording sheet P in the fixing nip. Subsequently, the recording sheet P is output outside the image forming apparatus from the fixing device 90 via a post-fixing delivery path after the fixing process.

According to the present embodiment, for forming a monochrome image, an orientation of a support plate supporting the primary transfer rollers 35Y, 35M, and 35C of the transfer unit 30 is changed by driving a solenoid or the like. With this configuration, the primary transfer rollers 35Y, 35M, and 35C are separated from the photoconductors 2Y, 2M, and 2C, thereby separating the outer peripheral surface or the image bearing surface of the intermediate transfer belt 31 from the photoconductors 2Y, 2M, and 2C. In a state in which the intermediate transfer belt 31 contacts only the photoconductor 2K, only the toner image forming unit 1K for black among four toner image forming units is driven to form a black toner image on the photoconductor 2K. It is to be noted that the present disclosure can be applied to both an image forming apparatus for forming a color image and a monochrome image forming apparatus for forming a single-color image.

Figure 3:
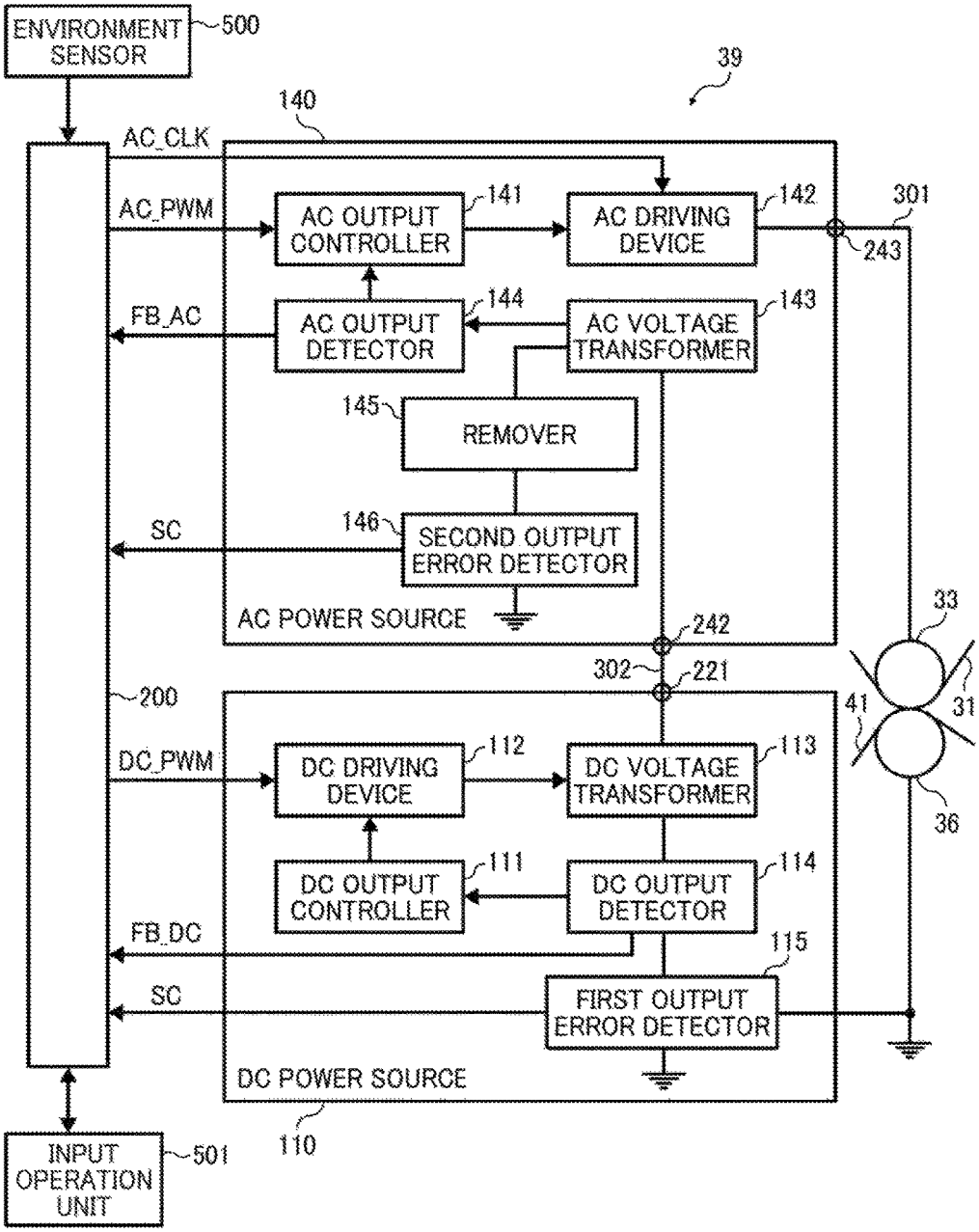
FIG. 3 is a block diagram of a portion of an electrical circuit of a secondary-transfer power source employed in the image forming apparatus of FIG. 1.
Figure 5:
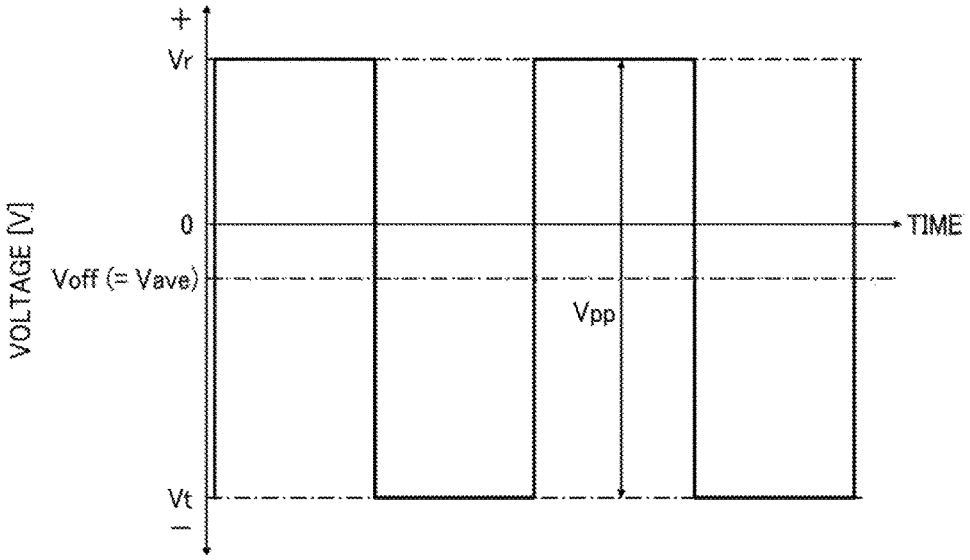
FIG. 5 is a graph of a waveform of a secondary-transfer bias including the superimposed voltage with an opposite-peak duty of 50% according to another embodiment of the present disclosure.

FIG. 3 is a block diagram of a portion of an electrical circuit of a secondary-transfer power source, and the secondary-transfer first roller 33 and the secondary-transfer second roller 36 according to an embodiment of the present disclosure. As illustrated in FIG. 5, the secondary-transfer power source 39 includes a direct-current (DC) power source 110 and an alternating current (AC) power source 140, a power-source controller 200, and so forth. The AC power source 140 is detachably mountable relative to a maim body of the secondary-transfer power source 39. The DC power source 110 outputs a DC voltage to apply an electrostatic force to toner on the intermediate transfer belt 31 so that the toner moves from the intermediate transfer belt 31 to the recording sheet P in the secondary-transfer nip N. The DC power source 110 includes a DC output controller 111, a DC drive device 112, a DC voltage transformer 113, a DC output detector 114, a first output error detector 115, and an electrical connector 221.

The AC power source 140 outputs an alternating current voltage to form an alternating electric field in the secondary transfer nip N. The AC power source 140 includes an AC output controller 141, an AC drive device 142, an AC voltage transformer 143, an AC output detector 144, a remover 145, a second output error detector 146, electrical connectors 242 and 243.

The power-source controller 200 controls the DC power source 110 and the AC power source 140, and is equipped with a central processing unit (CPU), a Read Only Memory (ROM), and a Random Access Memory (RAM). The power-source controller 200 inputs a DC_PWM signal to the DC output controller 111. The DC_PWM signal controls an output level of the DC voltage. Furthermore, an output value of the DC voltage transformer 113 detected by the DC output detector 114 is provided to the DC output controller 111. Based on the duty ratio of the input DC_PWM signal and the output value of the DC voltage transformer 113, the DC output controller 111 controls as follows. The DC_PWM signal controls an output level of the DC voltage. Based on the duty ratio of the input DC_PWM signal and the output value of the DC voltage transformer 113, the DC output controller 111 controls the DC voltage transformer 113 via the DC drive device 112 to adjust the output value of the DC voltage transformer 113 to an output value instructed by the DC_PWM signal.

The DC drive device 112 drives the DC voltage transformer 113 in accordance with the instruction from the DC output controller 111. The DC drive device 112 drives the DC voltage transformer 113 to output a DC high voltage having a negative polarity. In a case in which the AC power source 140 is not connected, the electrical connector 221 and the secondary-transfer first roller 33 are electrically connected by a harness 301 so that the DC voltage transformer 113 outputs (applies) a DC voltage to the secondary-transfer first roller 33 via the harness 301. In a case in which the AC power source 140 is connected, the electrical connector 221 and the electrical connector 242 are electrically connected by a harness 302 so that the DC voltage transformer 113 outputs a DC voltage to the AC power source 140 via the harness 302.

The DC output detector 114 detects and outputs an output value of the DC high voltage from the DC voltage transformer 113 to the DC output controller 111. The DC output detector 114 outputs the detected output value as a FB_DC signal (feedback signal) to the power-source controller 200 to control the duty of the DC_PWM signal in the power-source controller 200 so as not to impair transferability due to environment and load. According to the present embodiment, the AC power source 140 is detachably mountable relative to the body of the power-source controller 200. Thus, an impedance in the output path of the high voltage output is different between when the AC power source 140 is connected and when the AC power source 140 is not connected. Consequently, when the DC power source 110 outputs the DC voltage under constant voltage control the impedance in the output path changes depending on the presence of the AC power source 140, thereby changing a division ratio. Furthermore, the high voltage to be applied to the secondary-transfer first roller 33 varies, causing the transferability to vary depending on the presence of the AC power source 140.

In view of the above, according to the present embodiment, the DC power source 110 outputs the DC voltage under constant current control, and the output voltage is changed depending on the presence of the AC power source 140. With this configuration, even when the impedance in the output path changes, the high voltage to be applied to the secondary-transfer first roller 33 is kept constant, thereby maintaining reliably the transferability irrespective of the presence of the AC power source 140. Furthermore, the AC power source 140 can be detached and attached without changing the DC_PWM signal value. According to the present embodiment, the DC power source 110 is under constant-current control. Alternatively, in some embodiments, the DC power source 110 can be under constant voltage control as long as the high voltage to be applied to the secondary-transfer bias roller 68 is kept constant by changing the DC_PWM signal value upon detachment and attachment of the AC power source 140 or the like.

The first output error detector 115 is disposed on an output line of the DC power source 110. When an output error occurs due to a ground fault or other problems in an electrical system, the first output error detector 115 outputs an SC signal indicating the output error such as leakage to the power-source controller 200. With this configuration, the power-source controller 200 can stop the DC power source 110 to output the high voltage.

The power-source controller 200 inputs an AC_PWM signal and an output value of the AC voltage transformer 143 detected by the AC output detector 144. The AC_PWM signal controls an output level of the AC voltage based on the duty ratio of the input AC_PWM signal and the output value of the AC voltage transformer 143 as follows. The AC_PWM signal controls an output level of the AC voltage. Based on the duty ratio of the input AC_PWM signal and the output value of the AC voltage transformer 143, the AC output controller 141 controls the AC voltage transformer 143 via the AC drive device 142 to adjust the output value of the AC voltage transformer 143 to an output value instructed by the AC_PWM signal.

An AC_CLK signal to control the output frequency of the AC voltage is input to the AC drive device 142. The AC drive device 142 drives the AC voltage transformer 143 in accordance with the instruction from the AC output controller 141 and the AC_CLK signal. As the AC drive device 142 drives the AC voltage transformer 143 in accordance with the AC_CLK signal, the output waveform generated by the AC voltage transformer 143 is adjusted to a desired frequency instructed by the AC_CLK signal.

The AC drive device 142 drives the AC voltage transformer 143 to generate an AC voltage, and the AC voltage transformer 143 then generates a superimposed voltage in which the generated AC voltage and the DC high voltage output from the DC voltage transformer 113 are superimposed. In a case in which the AC power source 140 is connected, that is, the electrical connector 243 and the secondary-transfer first roller 33 are electrically connected by the harness 301, the AC voltage transformer 143 outputs (applies) the thus-obtained superimposed voltage to the secondary-transfer first roller 33 via the harness 301. In a case in which the AC voltage transformer 143 does not generate the AC voltage, the AC voltage transformer 143 outputs (applies) the DC high voltage output, from the DC voltage transformer 113 to the secondary-transfer first roller 33 via the harness 301. Subsequently, the voltage (the superimposed voltage or the DC voltage) output to the secondary-transfer first roller 33 returns to the DC power source 110 via the secondary-transfer second roller 36.

The AC output detector 144 detects and outputs an output value of the AC voltage from the AC voltage transformer 143 to the AC output controller 141. The AC output detector 144 outputs the detected output value as a FB_AC signal (feedback signal) to the power-source controller 200 to control the duty of the AC_PWM signal in the power-source controller 200 to prevent the transferability from dropping due to environment and load. The AC power source 140 carries out constant voltage control. Alternatively, in some embodiments, the AC power source 140 may carry out constant current control. The waveform of the AC voltage generated by the AC voltage transformer 143 (the AC power source 140) is either a sine wave or a square wave. According to the present embodiment, the waveform of the AC voltage is a short-pulse square wave. The AC voltage having a short-pulse square wave enhances image quality.

Note that the secondary-transfer power source 30 outputs the DC voltage under the constant current control to adjust the output voltage value so that the output current value coincides with a predetermined target current value. Further, the secondary-transfer power source 39 outputs the AC voltage under the constant voltage control to adjust the amplitude of the AC voltage so that the peak-to-peak value Vpp coincides with a predetermined target value.

Figure 4:
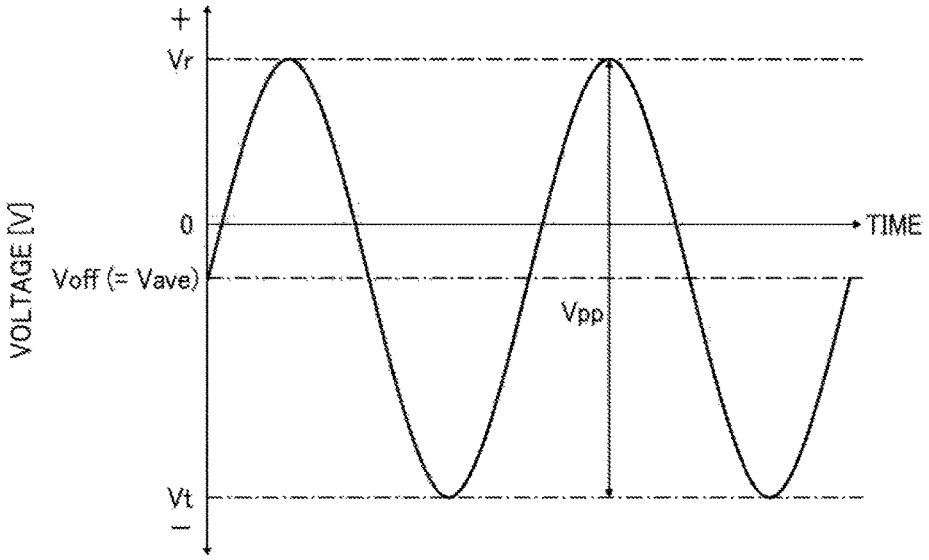
FIG. 4 is a graph of a waveform of a secondary-transfer bias including a superimposed voltage with an opposite-peak duty of 50% according to an embodiment of the present disclosure.
Figure 6:
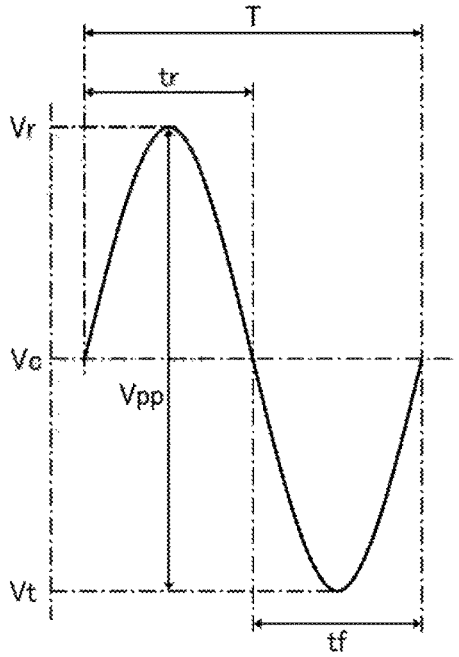
FIG. 6 is a graph for describing the opposite-peak duty of the secondary-transfer bias of FIG. 4.

A device is known that applies a superimposed voltage as the secondary-transfer bias to the secondary-transfer nip N to form the alternating electrical field which allows for a successful secondary transfer of toner onto recesses on the surface of the recording sheet having uneven surface. The principle is as follows: In the secondary transfer nip, the secondary-transfer bias including only the DC bias merely transfers a small amount of toner particles of toner forming a toner image from the surface of the intermediate transfer belt onto the recesses of the surface of the recording sheet. Similarly the secondary-transfer bias including the superimposed voltage merely transfers a small amount of toner particles onto the recesses of the surface of the recording sheet during a time period from a time when a toner image enters the secondary-transfer nip to a time when an initial cycle of the alternating current (AC) component of the secondary-transfer bias ends. However when another cycle (second cycle) following the initial cycle of the alternating current component ends, the amount of toner particles that transfers from the surface of the secondary transfer belt onto the recesses of the surface of the recording sheet increases. More specifically, in the first half of another cycle following the initial cycle, the toner particles moving from the recesses back to the surface of the secondary transfer belt collide with toner particle remaining on the surface of the secondary transfer belt, thereby reducing the adhesive force between the toner particles remaining on the surface and the other toner particles or the surface of the secondary transfer belt. In the second half of the cycle following the initial cycle, the toner particles having reduced the adhesive force as described above is caused to transfer from the surface of the secondary transfer belt onto the recesses of the surface of the recording sheet together with the toner particles having returned to the surface of the secondary transfer belt. In still another cycle following the second cycle of the alternating current component as well, the similar phenomenon occurs, thereby further increasing the amount of toner particles to he transferred onto the recesses of the surface of the recording sheet. With repetitive reciprocation of the toner particles between the surface of the secondary transfer belt and the recesses of the surface of the recording sheet in the secondary-transfer nip, the amount of toner particles to be transferred onto the recesses of the surface of the recording sheet gradually increases. When the trail end of the toner image exits the secondary-transfer nip, a sufficient amount of toner particles has been transferred into the recesses of the surface of the recording sheet FIG. 4 is a waveform chart of the secondary-transfer bias including the superimposed voltage according to an embodiment. In FIG. 4, the waveform of the secondary-transfer bias is sinusoidal. The offset voltage Voff is a value of the DC component (DC voltage) of the secondary-transfer bias including the superimposed voltage. The offset voltage Voff is negative in polarity in FIG. 4. When the waveform of the secondary-transfer bias is sinusoidal as illustrated in FIG. 6, the offset voltage Voff is the same as the average potential Vave for one cycle (T) of the secondary-transfer bias. That is, the average potential Vave is also negative in polarity in FIG. 4.

As in the image forming apparatus 1000 according to the present embodiment in which the secondary-transfer bias is applied to the metal core of the secondary-transfer first roller 33 (FIG. 1), the toner electrostatically moves in the transfer direction in the secondary-transfer nip N when the polarity of the secondary-transfer bias is the same as the normal charge polarity of toner. More specifically, the toner electrostatically moves from the surface of the intermediate transfer belt 31 onto the surface of the recording sheet in the secondary-transfer nip N. When the polarity of the secondary-transfer bias becomes opposite to the normal charge polarity of toner, the toner electrostatically moves in the direction opposite to the transfer direction with the secondary-transfer nip N. More specifically, the toner electrostatically moves from the surface of the recording sheet P onto the surface of the intermediate transfer belt 31 in the secondary-transfer nip N. In the present embodiment, the average potential Vave is made negative that is the same as the normal charge polarity of toner to reciprocally move toner between the surface of the intermediate transfer belt 31 and the surface of the recording sheet P within the secondary-transfer nip N. Thus, the toner relatively moves from the surface of the intermediate transfer belt 31 onto the surface of the recording sheet P. This allows for a successful secondary transfer of a toner image from the surface of the intermediate transfer belt 31 onto the surface of the recording sheet P.

In FIG. 4, the transfer peak value Vt is one of two peak values of one cycle (cycle T) of the secondary transfer bias. The secondary transfer bias with the transfer peak value Vt electrostatically moves toner from the surface of the intermediate transfer belt 31 toward the surface of the recording sheet P with a greater force. A peak value Vr is the other peak value of the two peak values. In other words, the peak value Vr is an opposite-peak value to the transfer peak value Vt. In the secondary-transfer bias of FIG. 4, the opposite-peak value Vr is an opposite polarity (positive polarity) to the polarity of the transfer peak value Vt.

The waveform of the secondary-transfer bias is not limned to the sinusoidal wave as illustrated in FIG. 4. Alternatively, any of a triangular wave and a rectangular wave of the secondary transfer bias is applicable. FIG. 5 is a waveform chart of the secondary-transfer bias including the superimposed voltage as a second example. In FIG. 5, the waveform of the secondary-transfer bias is rectangular. Each of the sinusoidal wave of the secondary-transfer bias in FIG. 4 and the rectangular wave of the secondary-transfer bias in FIG. 5 has a duty ratio of 50% on the opposite-peak side to be described below. Any secondary-transfer bias having the waveform with such characteristics has the average potential Vave that is the same as the offset voltage Voff for one cycle (cycle T). In other words, the value of the DC component is the same as the average potential Vave.

Next, a description is provided of experiments newly performed by the present inventors.

A typical intermediate transfer belt includes only a belt base made of hard material, such as a polyimide belt. For example, an image forming apparatus described in U.S.2014079418 drives such an intermediate transfer belt to travel at a linear velocity of 280 [mm/s] to form an image at a velocity of image formation for general users. The present inventors have performed a first experiment of printing a test image under the same conditions as in the image forming apparatus described in U.S.2014079418, the entire enclosure of which is incorporated by reference herein.

A test printer used in the experiments has a configuration similar to that of the image forming apparatus according to the present embodiment. As in the image forming apparatus described in U.S.2014079418, the test printer uses, as the intermediate transfer belt, a single-layer belt including only a base made of polyimide (PI) resin having a thickness of 60 μm. Micro-rubber hardness and martens hardness of the intermediate transfer belt are 100 and 240, respectively.

The micro-rubber hardness (micro hardness) is obtained by measuring the depth of indentation of the needle while deforming the portion of the intermediate transfer belt 31 with a predetermined pressing force, using Micro rubber hardness meter MD-1 (registered trademark) produced by KOBUNSHI KEIKI CO., LTD. The needle used in the experiment is type A having a diameter of 0.16 mm. The measurement was performed at 23° C. and 50% RH. The Martens hardness was measured by using the Fisher Scope (registered trademark HM 2000 manufactured by Fisher Instrument Company under the conditions that the load is 50 mN, the pressing time period is 10 seconds, the creep time period is 10 seconds, the temperature is 23° C., and the humidity is 50%.

The experiment was performed under laboratory atmospheric conditions at 23° C. and 50% RH. As described above, a test image that is a blue solid image was printed on Leathac 66 as a recording sheet having an uneven surface (registered trademark, manufactured by TOKUSHU PAPER MFG. CO., LTD.) having a ream weight of 215 kg, by using prototype image forming apparatus at a process linear velocity (the velocity of the intermediate transfer belt) of 280 mm/s. In this case, many white spots have occurred in the solid test image.

With respect to such an occurrence of white spots, the present inventors have found that the occurrence of white spots is caused by the electrical discharge in the secondary-transfer nip. More specifically, a sufficient amount of electric field is preferably generated in the transfer direction of toner to reciprocate toner in the secondary-transfer nip between the intermediate transfer belt and the recesses of Leathac 66, thereby transferring the toner onto the recesses of the uneven surface of Leathac 66. However, with an excessive increased peak-to-peak value of the AC voltage of the secondary-transfer bias, the electric discharge frequently occurs between the intermediate transfer belt and Leathac 66, thereby causing the occurrence of many white spots in a solid test image due to the electric discharge.

The present inventors have found that the secondary-transfer bias advantageously has the low duty with an opposite-peak duty of less than 50% prevent or reduce the occurrence of white spots doe to the electrical discharge.

FIG. 6 is a graph for describing the opposite-peak duty of the secondary-transfer bias of FIG. 4. In FIG. 6, a center potential Vc is a potential in the middle of a peak-to-peak value Vpp of the AC component (AC voltage) of the secondary-transfer bias. In FIG. 6, a time period tr on the opposite-peak side is a time period from a time when the value of the secondary-transfer bias starts rising from the center potential Vc toward the opposite-peak value Vr to a time when the value having reached the opposite-peak value Vr returns to the center potential Vc within one cycle (cycle T). Further, a time period tf on the transfer-peak side is a time period from a time when the value of the secondary-transfer bias starts rising from the center potential Vc toward the transfer-peak value Vt to a time when the value having reached the transfer-peak value Vt returns to the center potential Vc within one cycle (cycle T). The duty on the opposite-peak side (the opposite-peak duty) is a ratio of the time period tr on the opposite-peak side in the cycle T. In the case of the waveform in FIG. 7, the duty ratio is 50%. In other words, the waveform has an opposite-peak duty of 50%.

Figure 7:
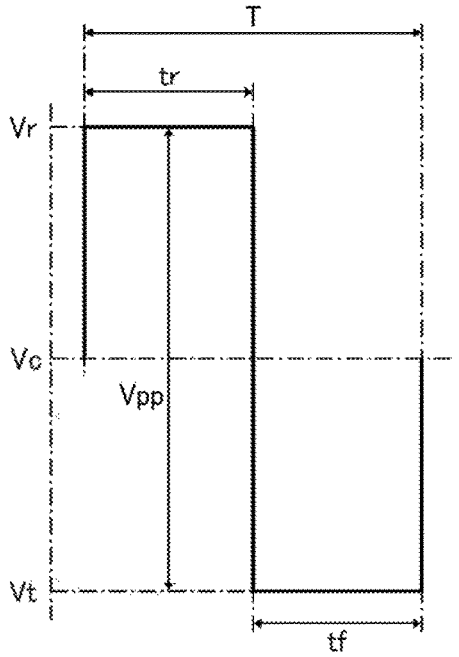
FIG. 7 is a graph for describing the opposite-peak duty of the secondary-transfer bias of FIG. 5.

FIG. 7 is a graph for describing the opposite-peak duty of the secondary-transfer bias of FIG. 5. In the rectangular wave of FIG. 7 as well, the opposite-peak duty is 50% as a ratio of the opposite-peak time period tr in the cycle T. Thus, the opposite-peak duty of the secondary-transfer bias is defined by the expression "tr/T×100%" when T is one cycle of the transfer bias, and Tr is a time period during which the transfer bias is on the opposite-peak side relative to the offset voltage of the transfer bias in the one cycle T.

To electrostatically move toner from the surface of the intermediate transfer belt 31 onto the surface of the recording sheet P within the secondary-transfer nip N with the secondary-transfer bias having an opposite-peak duty of 50%, the absolute value of the transfer-peak value Vt is preferably greater than the absolute value of the opposite-peak value Vr. With an excessively increased absolute value of the transfer-peak value Vt, electric discharge occurs within the secondary-transfer nip N between the surface of the intermediate transfer belt 31 and the Leathac 66 having an uneven surface. Such an electric discharge causes toner particles to be charged with the opposite polarity, thereby hampering the secondary transfer of the toner particles. As a result, many white spots occur in the image. Accordingly, the absolute value of the transfer-peak value Vt is preferably set to a certain value.

With an excessively reduced absolute value of the opposite-peak value Vr, a sufficient amount of toner fails to be transferred to the recesses of the Leathac 66 having an uneven surface. More specifically, with an excessively reduced absolute value of the opposite-peak value Vr, the toner particles having been temporarily transferred to the recesses of the sheet fail to return to the surface of the intermediate transfer belt in the secondary-transfer nip. Accordingly, the toner particles fails to return from the recesses of the sheet and collide with other toner particles adhering to the surface of the intermediate transfer belt, thus failing to reduce the adhesion force between the other toner particles and the surface of the intermediate transfer belt. Thus, the toner particles to be transferred into the recesses of the sheet fail to increase in number by merely vibrating the toner particles. As a result, an insufficient amount of toner is transferred into the recesses of the sheet.

Examples of the methods for increasing the opposite-peak value Vr include increasing the peak-to-peak value Vpp of the AC component. Increasing the peak-to-peak value Vpp to prevent the insufficient opposite-peak value Vr, however, increases the transfer-peak value Vt as well, which increases the possibility of the occurrence of white spots due to the electric discharge.

Alternatively, the offset value Voff is reduced to increase the opposite-peak value Vr. Reducing the offset value Voff reduces the average potential Vave, and thereby the toner fails to electrostatically move from the surface of the intermediate transfer belt onto the surface of the sheet, resulting in the secondary transfer failure.

To transfer a sufficient amount of toner into the recesses of the sheet having an uneven surface, it has been found that the opposite-peak duty is preferably less than 50%, With the opposite-peak duty of greater than or equal to 50%, the white spots due to the electric discharge and the secondary transfer failure occur. More specifically, with the opposite-peak duty of greater than or equal to 50%, the average potential Vave is shifted toward the opposite-peak side by the amount that exceeds the duty of 50% to reduce the absolute value of the average potential Vave, resulting in the occurrence of the secondary transfer failure. To avoid such a secondary transfer failure, if the peak-to-peak vale Vpp is increased to increase the average potential Vave, the transfer-peak value Vt increases, thereby increasing the possibility of occurrence of white spots due to the electric discharge. Thus, the opposite-peak duty is preferably less than 50%.

Figure 8:
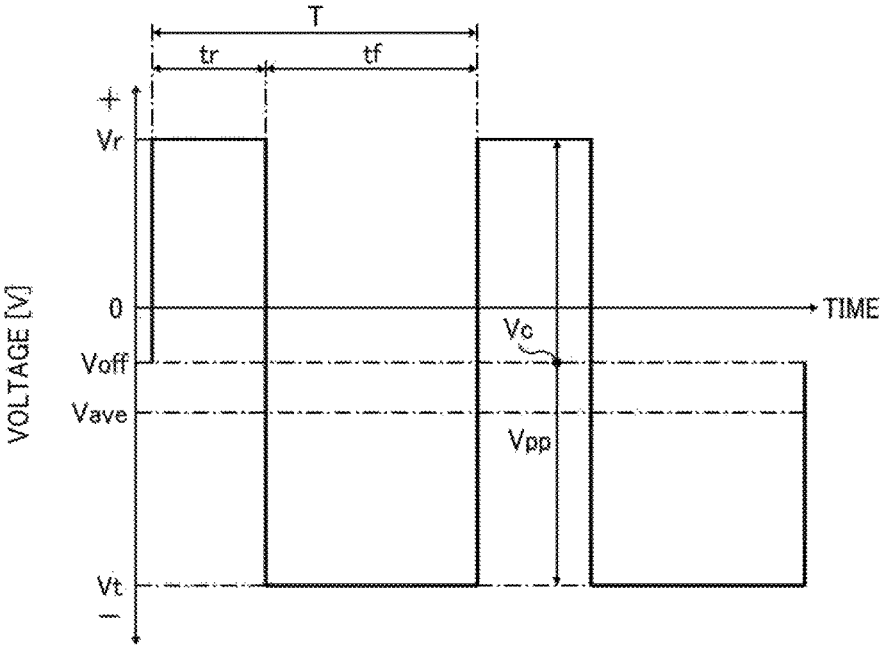
FIG. 8 is a graph of a waveform of a secondary-transfer bias having an opposite-peak duty of 35% according to an embodiment of the present disclosure.

FIG. 8 is a graph of a waveform of a secondary-transfer bias including the superimposed voltage with an opposite-peak duty of 35% that is less than 50% according to an embodiment of the present disclosure. The opposite-peak value Vr of the secondary-transfer bias in FIG. 8 is the same as the opposite-peak value Vr of the secondary-transfer bias in FIG. 5. The transfer-peak value Vt of the secondary-transfer bias in FIG. 8 is the same as the transfer-peak value Vt of the secondary-transfer bias in FIG. 5. The secondary-transfer bias in FIG. 8 differs from the secondary-transfer bias in FIG. 5 in the opposite-peak time period tr and the transfer-peak time period tf. In the secondary-transfer bias of FIG. 5, the opposite-peak time period tr is the same as the transfer-peak issue period tf. By contrast, in the secondary-transfer bias of FIG. 8, the opposite-peak time period tr is shorter than the transfer-peak time period tf. More specifically, in the secondary-transfer bias of FIG. 5, the length of the opposite-peak time period tr is 50% of the cycle T. By contrast, in the secondary-transfer bias of FIG. 8, the opposite-peak time period tr is of the cycle T. In other words, the secondary-transfer bias in FIG. 8 has an opposite-peak duty of 35%.

In the secondary-transfer bias of FIG. 5 having an opposite-peak duty of 50%, the offset voltage Voff is the same as the average potential Vave as described above. In the secondary-transfer bias of FIG. 8 having an opposite-peak duty of 35%, the average potential Vave is greater than the offset voltage Voff. The peak-to-peak value Vpp is common between the secondary-transfer bias in FIG. 5 and the secondary-transfer bias in FIG. 8. That is, with the opposite-peak duty of less than 50%, the average potential Vave successfully increases without, any changes in the peak-to-peak value Vpp. the transfer-peak value Vt, and the opposite-peak value Vr as compared to the case of the opposite-peak duty of 50%. Thus, with the opposite-peak duty of less than 50%, the secondary transfer failure and the occurrence of white spots are prevented or reduced as compared to the case of the opposite-peak duty of greater than or equal to 50%.

As described above, the image forming apparatus disclosed in U.S.2014079418 transfers an image onto the recording sheet having an uneven surface at a process linear velocity of 280 mm/s. However, there has been a demand for enhancing the speed in the marketplace. The inventors of the present, application have performed a second experiment of investigating a relationship between a print speed and image quality by using the above-described prototype image forming apparatus.

The prototype image forming apparatus includes the same intermediate transfer belt as the intermediate transfer belt employed in the first experiment. The experiment was performed under laboratory atmospheric conditions at 23° C. and 50% RH. As described above, a test image that is a blue solid image was printed on Leathac 66 having a ream weight of 215 kg as the recording sheet having an uneven surface, by using prototype image forming apparatus at various process linear velocities. The printed solid test image was evaluated for the transferability (transferability in unevenness) of toner relative to the recesses in the uneven surface of Leathac 66 with eyes. An evaluator having a normal eyesight visually graded the transferability in unevenness on a five point scale of Grade 1 to Grade 5. As the value of Grade increases, the transferability increases.

Solid test images were printed at a plurality of velocities using two types of secondary transfer bias, the secondary transfer bias including only the DC voltage and the secondary transfer bias including the superimposed voltage. The superimposed voltage employee; has a rectangular wave and the low duty in which the opposite-peak duty is 12%. Further, the superimposed voltage has a frequency of 0.8 kHz and a peak-to-peak value Vpp of 8 kV.

Experiment Conditions

Environment: 23° C. and 50%;

Intermediate transfer belt: a single-layer polyimide belt with a thickness of 60 μm;

Test image: a blue solid image (two-color composite image of magenta and cyan);

Recording sheet: Leathac 66 with a basis weight of 215 kg;

Type of secondary transfer bias: the secondary transfer bias including only the DC voltage and the secondary transfer bias including the superimposed voltage, and Peak-to-peak value Vpp of the superimposed voltage: 8 kV;

Frequency f of the superimposed voltage: 0.8 kHz;

Opposite-peak duty of the superimposed voltage: 12%;

DC component or DC voltage: −5 kV; and

Process linear velocity 152, 200, 350, 415, and 630 mm/s.

Figure 9:
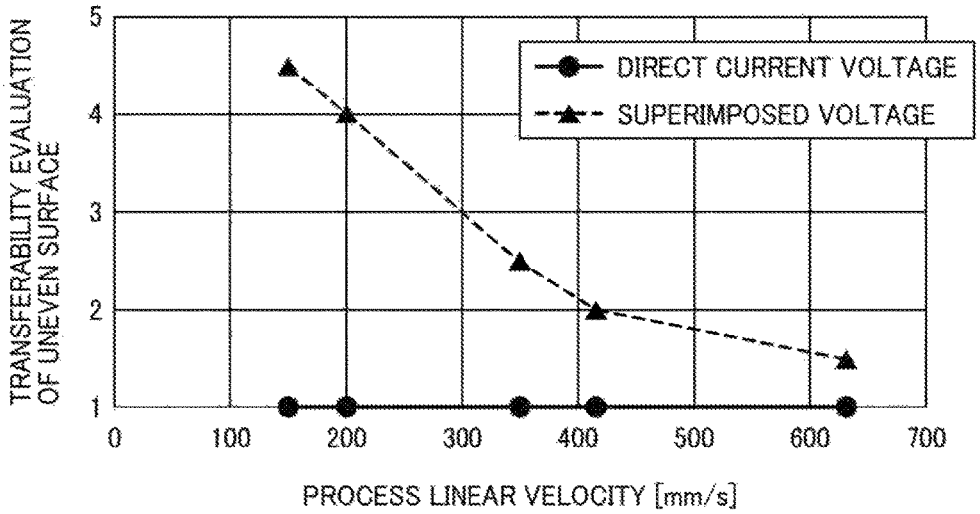
FIG. 9 is a graph of the relations of the transferability in recesses, a process linear velocity and a type of bias in a second experiment.

FIG. 9 is a graph of the relations between the transferability in unevenness, the process linear velocity, and types of bias in the second experiment. As illustrated in FIG. 9, when the secondary transfer bias including only the DC voltage was employed, the transferability in unevenness was evaluated as Grade 1 that, is the lowest irrespective of the process linear velocity. This is because the secondary transfer bias including only the DC voltage fails to reciprocate toner in the secondary-transfer nip between the intermediate transfer belt and the recesses of Leathac 66.

In contrast, when the secondary transfer bias including the superimposed voltage was employed, reducing the process linear velocity to be less than or equal to 200 mm/s achieved Grade 4 or less for the transferability in unevenness. However, increasing the process linear velocity to be greater than 200 mm/s failed to obtain Grade 4 or more for the transferability in unevenness. This is because reciprocating toner in the secondary-transfer nip between the intermediate transfer belt and the recesses of Leathac 66 was impossible. Particularly, at the ultra-high speed (process linear velocity of 630 mm/s) for business users, the transferability in unevenness was evaluated Grade 0.5 that is terrible. Thus, increasing the process linear velocity has difficulties in shortening the time period of passing through the secondary-transfer nip of toner and reciprocating the toner within the secondary-transfer nip as many times as needed.

To handle such circumstances, the peak-to-peak value Vpp of the secondary transfer bias is preferably increased in a relative manner to reciprocate toner within the secondary-transfer nip at a high speed. This is considered to enable reciprocating toner as many times as needed even during a short time period of toner passing through the secondary-transfer nip.

The inventors of the present application have performed a third experiment of investigating a relationship between a peak-to-peak value Vpp and image quality by using the above-described prototype image forming apparatus. In the third experiment, the prototype image forming apparatus includes the same intermediate transfer belt as the intermediate transfer belt employed in the first experiment and the second experiment. The secondary transfer bias employed in the third experiment includes the superimposed voltage, has a rectangular wave. The secondary transfer bias further has the low duty in which the opposite-peak duty is 12%. The third experiment adopted the process linear velocity of 630 mm/s at which particularly poor results were obtained in the third experiment. In the third experiment, the test images were printed at the peak-to-peak values Vpp of the secondary-transfer bias ranging from 7 kV through 13 kV in units of 1 kV (i.e., seven types of values were adopted), respectively. As the test images, a blued solid image and a textual image were printed.

The following lists the conditions for the third experiment.

Environment: 23° C. and 50%;

Intermediate transfer belt: a single-layer polyimide belt with a thickness of 60 μm;

Test image: a blue solid image and a textual image;

Recording sheet; Leathac 66 with a basis weight of 215 kg;

Type of secondary transfer bias: the secondary transfer bias including the superimposed voltage;

Peak-to-peak value Vpp of the superimposed voltage: 7, 8, 9, 10, 11, 12, and 13 kV;

Frequency f of superimposed voltage: 0.8 kHz;

Opposite-peak duty of superimposed voltage: 12%;

DC component (offset voltage Voff): −5 kV

Process Smear velocity: 630 mm/s; and

Recording sheet: Leathac 66 with a weight of 215 kg.

The blue test image was evaluated for the degree of white spots that, occur due to the electric discharge and the transferability in unevenness. The evaluator having a normal eyesight evaluated the rank of white spots on 5-point scale ranging from Grade 1 through Grade 5. In this case, as the value of Grade increases, the transferability increases.

The textual image was evaluated, for the degree of text scattering that is toner scattering around the text. The evaluator having a normal eyesight evaluated the rank of text scattering on 5-point scale ranging from Grade 1 through Grade 5. In this case, as the value of Grade increases, the transferability increases. Any evaluated value is almost 2.5 that is within the permissible range. The evaluated value is preferably greater than 3.5.

Figure 10:
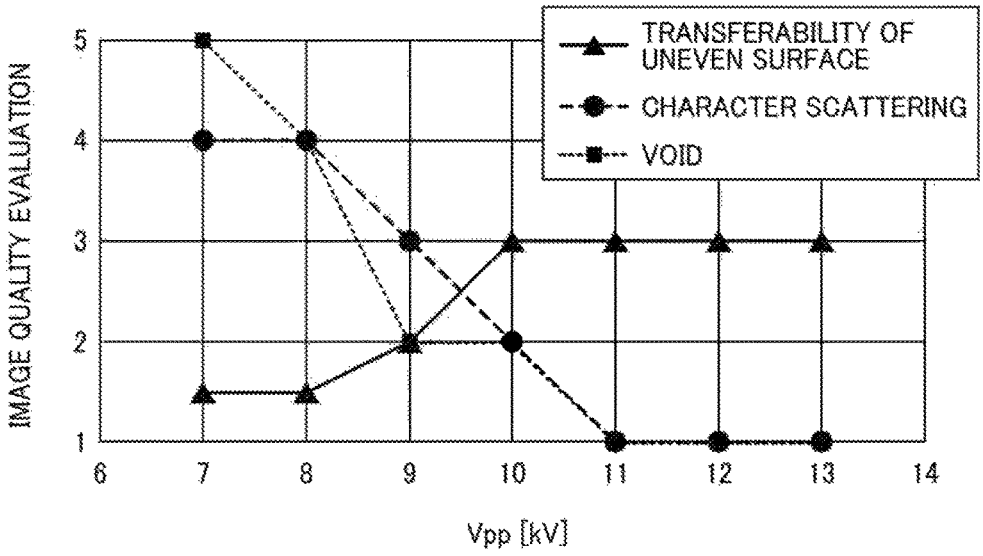
FIG. 10 is a graph of the relations of the evaluation of image quality and a peak-to-peak value Vpp in a third experiment.

FIG. 10 is a graph of the relations between the evaluation of image quality and a peak-to-peak value Vpp in the third experiment. As illustrated in FIG. 10, as the peak-to-peak value Vpp increases, the transferability in unevenness increases. This is because with an increase in peak-to-peak value Vpp, the return (opposite)-peak value Vr increases, thus reliably returning toner to the intermediate transfer belt. However, as the peak-to-peak value Vpp increases, the text scattering and white spots in an image deteriorates. The reason is as follows. With an increase in peak-to-peak value Vpp, the transfer-peak value Vt and the return (opposite)-peak value Vr increases, thereby increasing a maximum potential difference between the intermediate transfer belt and the recording sheet. Thus, the electric discharge becomes more likely to occur, thereby degrading the degree of white spots. Further, with an increase in transfer-peak value Vt and return (opposite)-peak value Vr, a force to crash toner particles onto the recording sheet increases, and thereby the toner particles becomes more likely to scatter around, thus degrading the evaluation of the text scattering.

Next, the present inventors performed a fourth experiment by using the intermediate transfer belt that has a certain degree of elasticity. More specifically, the intermediate transfer belt includes a base layer made of polyimide having a thickness of 60 μm and an elastic layer made of acrylic rubber having a thickness of 390 μm on the front surface of the base layer. The elastic layer includes microparticles each having a diameter of approximately 2 μm dispersed thereon. The microparticles constitute protrusions on the surface of the elastic layer. Micro-rubber hardness and Martens hardness of the intermediate transfer belt are 35.9 and 0.31, respectively. In the fourth experiment in which a multi-layer intermediate transfer belt having the above-described elasticity was used, image quality was evaluated in the same manner as in the third experiment.

The following lists the conditions for the fourth experiment.

Environment: 23° C. and 50%;

Intermediate transfer belt: a multi-layer elastic belt having a base layer with a thickness of 60 μm and an elastic layer with a thickness of 390 μm;

Test image: a blue solid image and a textual image;

Recording sheet: Leathac 66 with a basis weight of 215 kg;

Type of secondary transfer bias: the secondary transfer bias including the superimposed voltage;

Peak-to-peak value Vpp of the superimposed voltage: 7, 8, 9, 10, 11, 12, and 13 kV;

Frequency f of superimposed voltage: 0.8 kHz;

Opposite-peak duty of the superimposed voltage: 12%;

DC component (offset voltage Voff): −5 kV; and

Process linear velocity: 630 mm/s.

Figure 11:
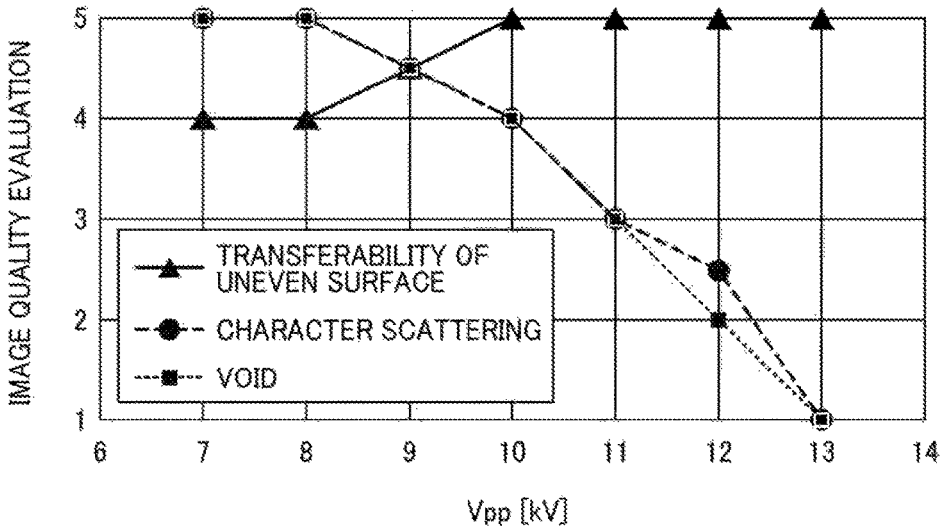
FIG. 11 is a graph of the relations of the evaluation of image quality and a peak-to-peak value Vpp in a third experiment.

FIG. 11 is a graph of the relations between the evaluation of image quality and a peak-to-peak value Vpp in the fourth experiment. As illustrated in FIG. 11, as the peak-to-peak value Vpp increases, the transferability in unevenness increases. However, the degrees of the text scattering and white spots deteriorate in the same manner as in the third experiment. However, in terms of the peak-to-peak value Vpp, the evaluation results of the text scattering and white spots were belter in the fourth experiment than in the third experiment. This is considered to be because the elastic layer is deformed in the secondary-transfer nip in conformity of the shape of the unevenness of the surface of Leathac 66 to reduce the distance between the bottom of the recesses and the surface of the intermediate transfer belt, thereby reliably reciprocating toner therebetween. Further, it is conceivable that such a deformation of the elastic Saver increased the contact of the intermediate transfer belt with the surface of Leathac 66, and thereby the degree of the text scattering was improved. Further, the contact, of the intermediate transfer belt with the recording sheet (Leathac 66) increases to eliminate the space, between the intermediate transfer belt and the surface of Leathac 66. This could be seen the reason to prevent the occurrence of the electric discharge and thereby increase the evaluation results of the white spots.

As illustrated in FIG. 11, it can be seen that the use of the intermediate transfer belt having a good elastic property results in any of the transferability in unevenness, the text scattering, and the white spot being evaluated as Grade 4 or more.

Next, a description is provided of a characteristic configuration of the image forming apparatus 1000 according to the present embodiment of the present disclosure.

In view of the results of test 4 as described above, an elastic belt is used as the intermediate transfer belt 31 in the image forming apparatus according to the present embodiment.

Figure 12:
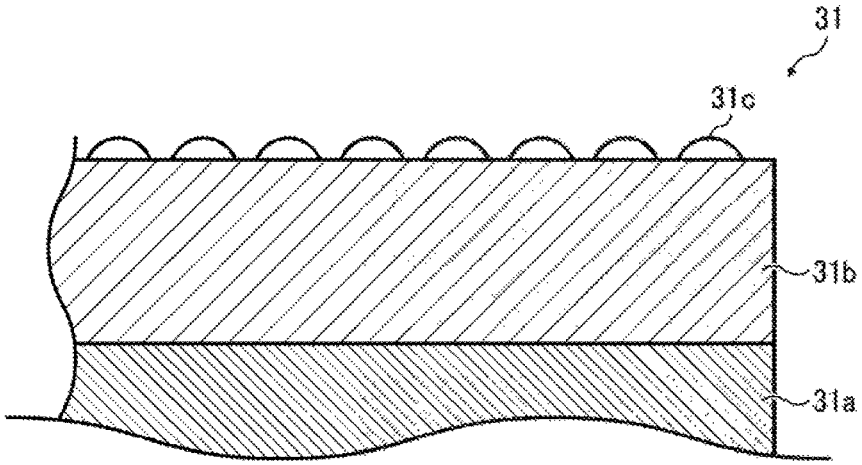
FIG. 12 is a partially enlarged cross-sectional view of an intermediate transfer belt employed in the image forming apparatus of FIG. 1.
Figure 13:
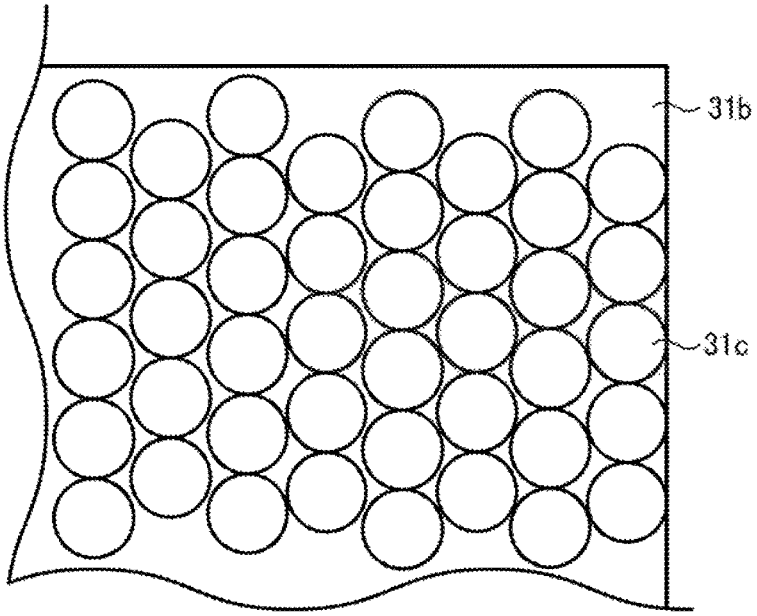
FIG. 13 is a partially enlarged plan view of the intermediate transfer belt of FIG. 12.

FIG. 12 is a partially enlarged cross-sectional view of a transverse plane of the intermediate transfer belt 31 made of an elastic belt mounted on the image forming apparatus according the present embodiment. The intermediate transfer belt 31 includes a base layer 31*a* (belt base layer made of hard material) and an elastic layer 31*b*. The base layer 31*a* formed into an endless looped belt is formed of a material having a high stiffness, but having some flexibility The elastic layer 31*b* disposed on the front surface of the base layer 31*a* is formed of an elastic material with high elasticity. Particles 31*c* are dispersed in the elastic layer 31*b*. While a portion of the particles 31*c* projects from the elastic layer 31*b*, the particles 31*c* are arranged concentratedly in a belt surface direction as illustrated in FIG. 4. With these particles 31*c*, an uneven surface of the belt with a plurality of bumps is formed on the intermediate transfer belt 31.

Examples of materials for the base layer 31*a* include, but are not limited to, a resin in which an electrical resistance adjusting material made of a filler or an additive is dispersed to adjust electrical resistance. Examples of the resin constituting the base layer 31*a* include, but are not limited to, fluorine-based resins such as ethylene tetrafluoroethylene copolymers (ETFE) and polyvinylidene fluoride (PVDF), and polyimide resins or polyamide-imide resins in terms of flame retardancy. In terms of mechanical strength (high elasticity) and heat resistance, specifically, polyimide resins or polyamide-imide resins are more preferable.

Examples of the electrical resistance adjusting materials dispersed in the resin include, but are not limited to, metal oxides, carbon blacks, ion conductive materials, and conductive polymers. Examples of metal oxides include, but are not limited to, zinc oxide, tin oxide, titanium oxide, zirconium oxide, aluminum oxide, and silicon oxide. In order to enhance dispersiveness, surface treatment may be applied to metal oxides in advance. Examples of carbon blacks include, but are not limited to, ketchen black, furnace black, acetylene black, thermal black, and gas black. Examples of ion conductive materials include, but are not limited to, tetraalkylammonium salt, trialkyl benzyl ammonium salt, alkylsulfonate, and alkylbenzene sulfonate. Examples of ion conductive materials include, but are not limited to, tetraalkylammonium salt, trialkyl benzyl ammonium salt, alkylsulfonate, alkylbenzene sulfonate, alkylsulfate, glycerol esters of fatty acid, sorbitan fatty acid ester, polyoxyethylene alkylamine, polyoxyethylene aliphatic alcohol ester, alkylbetaine, and lithium perchlorate. Two or more ion conductive materials can be mixed. It is to be noted that electrical resistance adjusting materials are not limited to the above-mentioned materials.

A dispersion auxiliary agent, a reinforcing material, a lubricating material, a heat conduction material, an antioxidant, and so forth may be added to a coating liquid which is a precursor for the base layer 310, as needed. The coating solution is a liquid resin before curing in which electrical resistance adjusting materials are dispersed. An amount of the electrical resistance adjusting materials to be dispersed in the base layer 31*a* of a seamless belt, i.e., the intermediate transfer belt 33 is preferably in a range from $1\times10^{8}$ to $1\times10^{13}$ ·/sq in surface resistivity, and in a range from $1\times10^{6}$ to $10^{12}$ ·•cm in volume resistivity. In terms of mechanical strength, an amount of the electrical resistance adjusting material to be added is determined such that the formed film is not fragile and does not crack easily. Preferably, a coaling liquid, in which a mixture of the resin component (for example, a polyimide resin precursor and a polyamide-imide resin precursor) and the electrical resistance adjusting material are adjusted properly, is used to manufacture a seamless belt (i.e., the intermediate transfer belt) in which the electrical characteristics (i.e., the surface resistivity and the volume resistivity) and the mechanical strength are well balanced. The content of the electrical resistance adjusting material in the coating liquid when using carbon black is in a range from 10% through 25% by weight or preferably, from 15% through 20% by weight relative to the solid content. The content of the electrical resistance adjusting material in the coating liquid when using metal oxides is approximately 1% through 50% by weight or more preferably, in a range from 10% through 30% by weight relative to the solid content. If the content of the electrical resistance adjusting material is less than the above-described respective range, a desired effect is not achieved. If the content of the electrical resistance adjusting material is greater than the above-described respective range, the mechanical strength of the intermediate transfer belt (seamless belt) 31 drops, which is undesirable in actual use.

The thickness of the base layer 31*a* is not limited to a particular thickness and can be selected as needed. The thickness of the base layer 31*a* is preferably in a range from 30 μm to 150 μm, more preferably in a range from 40 μm to 120 μm, even more preferably, in a range from 50 μm to 80 μm. The base layer 31*a* having a thickness of less than 30 μm cracks and gets torn easily. The base laser 31 a having a thickness of greater than 150 μm cracks when it is bent. By contrast, if the thickness of the base layer 31*a* is in the above-described respective range, the durability is enhanced.

In order to increase the stability of traveling of the intermediate transfer belt 31, preferably, the thickness of the base layer 31*a* is uniform as much as possible. An adjustment method to adjust, the thickness of the base layer 31*a* is not limited to a particular method, and can be selected as needed. For example, the thickness of the base layer 31*a* can be measured using a contact-type or an eddy-current thickness meter or a scanning electron microscope (SEM) which measures a cross-section of the film.

As described above, the elastic layer 31*b* of the intermediate transfer belt 31 includes a plurality of raised portions with the particles 31*c* dispersed in the elastic laser 31*b*. Examples of elastic materials for the elastic layer 31*b* include, but are not limited to, generally-used resins, elastomers, and rubbers Preferably, elastic materials having good elasticity such as elastomer materials and rubber materials are used. Examples of the elastomer materials include, but are not limited to, polyesters, polyamides, polyethers, polyurethanes, polyolefins, polystyrenes, polyacrylics, polydiens, silicone-modified polycarbonates, and thermoplastic elastomers such as fluorine-containing copolymers. Alternatively, thermoplastic elastomer, such as fluorine-based copolymer thermoplastic elastomer, may be employed. Examples of thermosetting resins include, but are not limited to, polyurethane resins, silicone-modified epoxy resins, and silicone modified acrylic resins. Examples of rubber materials include, but are not limited to isoprene rubbers, styrene rubbers, butadiene rubbers, nitrile rubbers, ethylene-propylene rubbers, butyl rubbers, silicone rubbers, chloroprene rubbers, and acrylic rubbers. Examples of rubber materials include but are not limited to, chlorosulfonated polyethylenes, fluorocarbon rubbers, urethane rubbers, and hydrin rubbers. A material having desired characteristics can be selected from the above-described materials, in particular, its order to accommodate a recording sheet with art uneven surface such as Leathac®, soft materials are preferable. Because the particles 31*c* are dispersed, thermosetting materials are more preferable than thermoplastic materials. The thermosetting materials have a good adhesion property relative to resin particles due to an effect of a functional group contributing to the curing reaction, thereby fixating reliably. For the same reason, vulcanized rubbers are also preferable.

In terms of ozone resistance, softness, adhesion properties relative to the particles, application of flame retardancy, environmental stability, and so forth, acrylic rubbers are most preferable among elastic materials for forming the elastic layer 311. Acrylic rubbers are not limited to a specific product. Commercially-available acrylic rubbers can be used. An acrylic rubber of carboxyl group crosslinking type is preferable since the acrylic rubber of the carboxyl group crosslinking type among other cross linking types (e.g., an epoxy group, an active chlorine group, and a carboxyl group) provides good rubber physical properties (specifically, the compression set) and good workability. Preferably, amine compounds are used as crosslinking agents for the acrylic rubber of the carboxyl group crosslinking type. More preferably, multivalent amine compounds are used. Examples of the amine compounds include, but are not limited to, aliphatic multivalent amine crosslinking agents and aromatic multivalent amine crosslinking agents. Furthermore, examples of the aliphatic multivalent amine crosslinking agents include, but are not limited to, hexamethylenediamine, hexamethylenediamine carbamate, and N,N'-dicinnamylidene-1,6-hexanediamine.

Examples of the aromatic multivalent amine crosslinking agents include, but are not limited to, 4,4'-methylenedianiline, m-phenylenediamine, 4,4'-diaminodiphenyl ether, 3,4'-diaminodiphenyl ether, 4,4'-phenylenediisopropylidene)

dianiline, 4,4'-(p-phenylenediisopropylidene) dianiline, 2,2'-bis(4-(4-aminophenoxy)phenyl; propane, 4,4'-diaminobenzanilide, 4,4'-bis(4-aminophenoxy)biphenyl, m-xylylenediamine, p-xylylenediamine, 1,3,5-benzenetriamine, and 1,3,5-benzenetriaminomethyl.

The amount of the crosslinking agent is, preferably, in a range from 0.05 to 20 parts by weight, more preferably, from 0.1 to 5 parts by weight, relative to 100 parts by weight of the acrylic rubber. An insufficient amount of the crosslinking agent causes failure in crosslinking, hence complicating efforts to maintain the shape of crosslinked products. By contrast, too much crosslinking agent causes crosslinked products to be too stiff, hence degrading elasticity as a crosslinking rubber.

In order to enhance a cross-linking reaction, a crosslinking promoter may be mixed in the acrylic rubber employed for the elastic layer 31*b*. The type of crosslinking promoter is not limited particularly. However, it is preferable that the crosslinking promoter can be used with the above-described multivalent amine crosslinking agents. Such crosslinking promoters include, but are not limited to, guanidino compounds, imidazole compounds, quaternary onium salts, tertiary phosphine compounds, and weak acid alkali metal salts. Examples of the guanidino compounds include, but are not limited to, 1,3-diphenylguanidine and 1,3-di-o-tolylguanidine. Examples of the imidazole compounds include, but are not limited to, 2-methylimidazole and 2-phenylimidazole. Examples of the quaternary onium salts include, but are not limited to, tetra-n-butylammonium bromide and octadecyltri-n-butylammonium bromide. Examples of the multivalent tertiary amine compounds include, but are not limited to triethyienediamine and 1,8-diazabicyclo[5.4.0] undec-7-ene (DBU). Examples of the tertiary phosphines include, but are not limited to, triphenylphosphine and tri (p-tolyl)phosphine. Examples of the weak acid alkali metal salts include, but are not limited to, phosphates such as sodium and potassium, inorganic weak acid salts such as carbonate or stearic acid salt, and organic weak acid salts such as lauric acid salt.

The amount of the crosslinking promoter is, preferably, in a range from 0.1 to 20 parts by weight, more preferably, from 0.3 to 10 parts by weight, relative to 100 parts by weight of the acrylic rubber. Too much crosslinking promoter causes undesirable acceleration of crosslinking during crosslinking, generation of bloom of the crosslinking promoter on the surface of crosslinked products, and hardening of the crosslinked products. By contrast, an insufficient amount of the crosslinking agent causes degradation of the tensile strength of the crosslinked products and a significant elongation change or a significant change in the tensile strength after heat load.

The acrylic rubber composition of the present disclosure can be prepared by an appropriate mixing procedure such as roll mixing, Banbury mixing, screw mixing, and solution mixing. The order in which the ingredients are mixed is not particularly limited. However, it is preferable that ingredients that are not easily reacted or decomposed w hen heated are first mixed thoroughly, and thereafter, ingredients that are easily reacted or decomposed when heated, such as a crosslinking agent, are mixed together in a short period of time at a temperature at which the crosslinking agent is neither reacted not decomposed.

When heated, the acrylic rubber serves as a crosslinked product. The heating temperature is preferably in a range of 130° C. through 220° C., more preferably, 140° C. through 200° C. The crosslinking time period is preferably in a range of 30 seconds through 5 hours. The heating methods can be chosen from those which are used for crosslinking rubber compositions, such as press heating, steam heating, oven heating, and hot-air heating. In order to reliably crosslink the inside of the crosslinked product, post crosslinking may be additionally carried out after crosslinking is carried out once. The post crosslinking time period varies depending on the heating method, the crosslinking temperature and the shape of crosslinked product, but is carried out preferably for 1 through 48 hours. The heating method and the heating temperature may be appropriately chosen. Electrical resistance adjusting agents for adjustment of electrical characteristics and flame retardants to achieve flame retardancy may be added to the selected materials. Furthermore, antioxidants, reinforcing agents, fillers, and crosslinking promoters may be added as needed. The electrical resistance adjusting agents to adjust electrical resistance can be selected from the above-described materials. However, since the carbon blacks and the metal oxides impair flexibility, it is preferable to minimize the amount of use. Ion conductive materials and conductive high polymers are also effective. Alternatively, these materials can be used in combination.

Preferably, various types of perchlorates and ionic liquids in an amount from about 0.01 parts by weight to 3 parts by weight are added, based on 100 parts by weight of rubber With the ion conductive material in an amount 0.01 parts by weight or less, the resistivity cannot be reduced effectively. However, with the ion conductive material in an amount 3 parts by weight or more, it is highly possible that the conductive material blooms or bleeds to the belt surface.

The electrical resistance adjusting material to be added is in such an amount that the surface resistivity of the elastic layer 31*b* is preferably, in a range from $1\times10^{8}$ ·/sq to $1\times10^{13}$ ·/sq, and the volume resistivity of the elastic layer 31*b* is, preferably, in a range from $1\times10^{6}$ ·•cm to $1\times10^{12}$ ·•cm.

The layer thickness of the elastic layer 31*b* is preferably, in a range from 200 μm to 2 mm, more preferably, 400 μm to 1000 μm. The layer thickness less than 200 μm hinders deformation of the belt in accordance with the roughness (surface condition) of the recording sheet and a transfer-pressure reduction effect. By contrast, the layer thickness greater than 2 mm causes the elastic layer 31*b* to sag easily due to its own weight, resulting in unstable movement of the intermediate transfer belt 31 and damage to the intermediate transfer belt 31 looped around rollers. The layer thickness can be measured by observing the cross-section of the elastic layer 31*b* using a scanning electron microscope (SEM), for example.

The particle 31*c* to be dispersed in the elastic material of the elastic layer 31*b* is a spherical resin particle having an average particle diameter of equal to or less than 100 μm and is insoluble in an organic solvent. Furthermore, the 3% thermal decomposition temperature of these resin particles is equal to or greater than 200° C. The resin material of the particle 31*c* is not particularly limited, but may include acrylic resins, melamine resins, poly amide resins, polyester resins, silicone resins, fluorocarbon resins, and rubbers. Alternatively, in some embodiments, surface processing with different material is applied to the surface of the particle made of resin materials, A surface of a spherical mother particle made of rubber may be coated with a hard resin. Furthermore, the mother particle may be hollow or porous.

Among such resins mentioned above, the silicone resin particles are most preferred because the silicone resin particles provide good slidability, separability relative to toner, and wear and abrasion resistance. Preferably, the spherical resin particles are prepared through a polymerization process. The more spherical the particle is the more preferred.

Preferably, the volume average particle diameter of the particle is in a range from 1.0 μm to 5.0 μm, and the particle dispersion is monodisperse with a sharp distribution The monodisperse particle is not a particle with a single, particle diameter. The monodisperse particle is a panicle having a sharp particle size distribution. More specifically, the distribution width of the particle is equal to or less than ±(Average particle diameter×0.5 μm). With the particle diameter of the particle 31*c* less than 1.0 μm, enhancement of transfer performance by the particle 31*c* cannot be achieved sufficiently. By contrast, with the particle diameter greater than 5.0 μm, the space between the particles increases, which results in an increase in the surface roughness of the intermediate transfer belt 31. In this configuration, toner is not transferred well, and the intermediate transfer belt 31 cannot be cleaned well. In general the particle 31*c* made of resin material has a relatively high insulation property. Thus, if the particle diameter is too large, accumulation of electrical charges of the particle 31*c* during continuous printing causes image defect easily.

Either commercially-available products or laboratory-derived products may be used as the particle 31*c*. The thus-obtained particle 31*c* is directly applied to the elastic layer 31*b* and evened out, thereby evenly distributing the particle 31*c* with ease. With this configuration, an overlap of the particles 31*c* in the belt thickness direction is reduced, if not prevented entirely. Preferably, the cross-sectional diameter of the plurality of particles 31*c* in the surface direction, of the elastic layer 31*b* is as uniform as possible. More specifically; the distribution width thereof is equal to or less than ±(Average particle diameter×0.5 μm). For this reason, preferably, powder including particles with a small particle diameter distribution is used as the particles 31*c*. If the particles 31*c* having a specific particle diameter can be applied to the elastic layer 31*b* selectively, it is possible to use panicles having a relatively large particle diameter distribution. It is to be noted that timing at which the particles 31*c* are applied to the surface of the elastic layer 31*b* is not particularly limited. The particles 31*v* can be applied before or after crosslinking of the elastic material of the elastic layer 31*b*.

Preferably, a projected area ratio of a portion of the elastic layer 31*b* having the particles 31*c* relative to the elastic layer 31*b* with its surface being exposed is equal to or greater than 60% in the surface direction of the elastic layer 31*b*. In a case in which the projected area ratio is less than 60%, the frequency of direct contact between toner and the pure surface of the elastic layer 31*b* increases, thereby degrading transferability of toner, cleanability of the belt surface from which toner is removed, and filming resistance. In some embodiments, a belt without the particles 31*c* dispersed in the elastic layer 31*b* can be used as the intermediate transfer belt 31*b*.

As illustrated in FIG. 4, no particles 31*c* overlapping each other are observed on the surface of the intermediate transfer belt 31. Preferably, the cross-sectional diameters of the plurality of particles 31*c* in the surface of the elastic layer 31*b* are as uniform as possible. More specifically, the distribution width thereof is preferably equal to or less than ±(Average particle diameter×0.5 μm). For this reason, preferably, powder including particles with a small particle diameter distribution is used as the particles. If the particles 31*c* having a specific particle diameter can be selectively localized in the elastic layer 31*b*, power including particles with a large particle diameter distribution may be used.

Paper having an uneven surface, such as Japanese paper called "Washi" is used as the recording sheet P. When paper having an uneven surface, such as Japanese paper called "Washi" is used as a recording sheet P, an elastic layer 31*b* having good elasticity is used to successfully secondarily transfer toner onto recessed portions of the recording sheet P, which prevents uneven image density due to the uneven surface. However, such an elastic layer 31*b* is not practical because the elastic layer 31*b* easily elongates after being stretched out. This is because, the elastic layer 31*b* includes a base layer 31*a* having more rigidity than the elastic layer 31*b*, which suppresses the elongation of the entire belt over a long time period.

As described above, the image forming apparatus 1000 according to the present embodiment employs the intermediate transfer belt 31 that is an elastic belt including the base layer 31*a* and the elastic layer 31*b* laminated on the base layer 31*a*. This allows for a successful secondary transfer of a sufficient amount of toner into the recesses of the recording sheet having an uneven surface, thus effectively preventing the occurrence of the uneven image density due to the uneven surface of the sheet even at the ultra-high speed (process linear velocity of 630 mm/s) for business users.

Note that in the image forming apparatus according the present embodiment, the secondary transfer bias having an opposite-peak duty of less than or equal to 50% is employed to transfer a sufficient amount of toner onto the recesses of the uneven surface of the recording sheet. More specifically, the secondary-transfer bias employed reverses the polarity thereof during, one cycle and has an opposite-peak duty of less than 50%. Such a configuration successfully prevents or reduces the secondary transfer failure and the occurrence of white spots due to the electrical discharge as compared to cases in which the secondary-secondary transfer bias has an opposite-peak duty of greater than or equal to 50%. Hereinafter, the property that the opposite-peak duty is less than 50% is referred to as low duty. The property that the opposite-peak duty is greater than 50% is referred to as high duty.

When the smooth sheet (having little or no recesses in the surface) as the recording sheet having a higher surface smoothness is used, there is no need to reciprocate toner between the intermediate transfer belt 31 and the smooth sheet With no toner reciprocating between the intermediate transfer belt 31 and the smooth sheet, the occurrence of text scattering can he effectively prevented or reduced.

Accordingly, the present inventors have performed the fifth experiment in which a single-color halftone image and a single-color solid image are secondarily transferred onto a recording sheet P that is a coated sheet with a good surface smoothness under the conditions that the secondary-transfer bias including only the DC voltage instead of the superimposed voltage including the AC component is used. The single-color halftone image is a halftone image having the toner adhesion amount per unit area reduced by the area coverage modulation to approximately one-fourth of the toner adhesion amount of the single-color solid image. The intermediate transfer belt is the same elastic belt as in the fourth experiment. In the fifth experiment, test images were printed with changes in output value (DC voltage) of the secondary transfer bias.

The following lists the conditions for the fifth experiment.

Environment: 23° C. and 50%;

Intermediate transfer belt: a multi-layer elastic belt having a base layer with a thickness of 60 μm and an elastic layer with a thickness of 300 μm;

Test image: a single-color halftone image and a single-color solid image;

Recording sheet: POD gloss coat 128 produced by Oji paper Co., Ltd. (coated paper);

Type of secondary transfer bias: the secondary transfer bias including only the DC voltage; and Process linear velocity: 630 mm/s.

The transfer rates of the printed single-color solid linage and single-color halftone image were measured. First, when a halftone image is primarily transferred onto the intermediate transfer belt 31, a test machine is stopped and a vacuum collects the toner of the test image from the intermediate transfer belt 31 to measure the weight of the collected toner as the total weight. Next, the test, image is primarily transferred onto the intermediate transfer belt 31 under the same conditions as the previous primary transfer, and the primarily-transferred halftone image is secondarily transferred onto a POD gross coated sheet 128 immediately thereafter. Then, the test printer is stopped immediately after the secondary transfer, and the vacuum collects the untransferred residual toner on the intermediate transfer belt 31 to measure the weight of the collected residual toner as the amount of untransferred residual toner (sometimes referred to simply as residual toner). The transfer rate is obtained by a solution of "(the total weight−residual toner)/the total amount×100".

Figure 14:
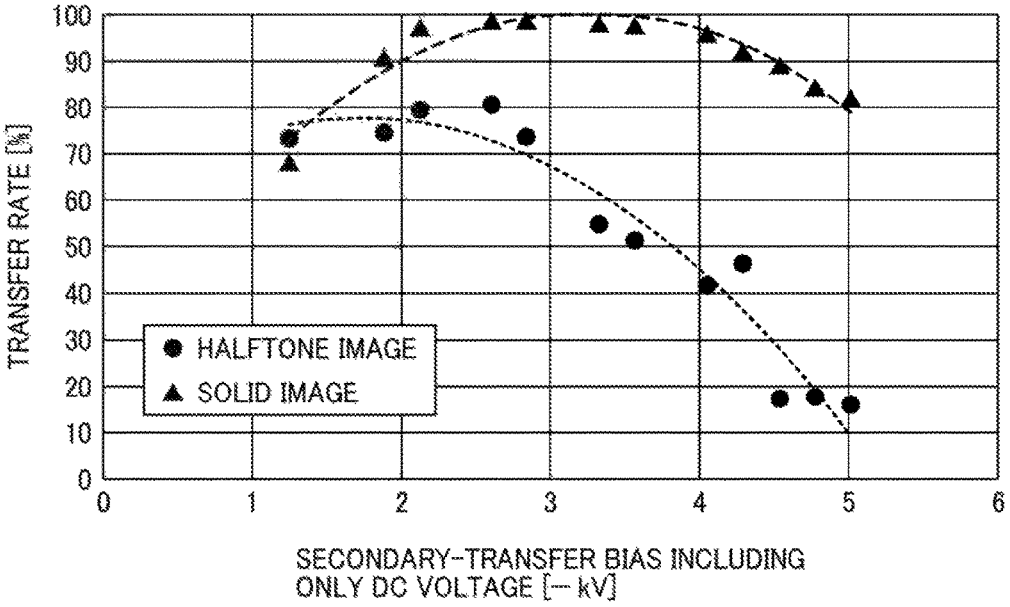
FIG. 14 is a graph of relations between the transfer rate and a DC voltage value of the secondary transfer bias in a fifth experiment.

FIG. 14 is a graph of relations between the transfer rate and the DC voltage value of the secondary-transfer bias in the fifth experiment. As illustrated in FIG. 14, a favorable transfer rate was obtained for the single-color solid image, but the transfer rate of the single-color halftone image was extremely poor. With respect to such a secondary transfer failure, the present inventors have recognized the following the entire primed area of the halftone image of a single color is not covered with toner. The pruned area includes to toner-adhesion spots that constitute relatively few-dot groups and a white space to which no toner adheres. The intermediate transfer belt 31 including the elastic layer 31*b* is used and a smooth sheet having a good surface smoothness is used as the recording sheet P. In this case, the elastic layer 31*b* flexibly deforms in conformity with the shapes of the few-dot toner masses each of which constitutes the few-dot group in the halftone image within the secondary-transfer nip N. The elastic layer 31*b* deforms to cover the surfaces as well as the side surfaces of the few-dot toner masses in the single-color halftone image. This injects charges having the opposite polarity of the normal charge polarity into the toner particles of the few-dot toner masses, thereby reducing the charge amount of toner (Q/M) or causing the toner to be charged with the opposite polarity. It has been found that this results in the secondary transfer failure of a toner Image. Note that when the uneven surface sheet is used as the recording sheet P, the elastic layer 31*b* deforms into irregular shapes in conformity with the unevenness of the uneven surface sheet, thereby leading to little possibility of covering the side surfaces of the few-dot toner masses by the elastic layer 31*b*. Thus, no secondary transfer failure occurs on the protrusions of the uneven stir face sheet as well.

Next, the present inventors have performed the sixth experiment in which a halftone image is secondarily transferred onto a smooth sheet using the secondary-transfer bias having the high duty (the opposite-peak duty is 80%) is used instead of the secondary-transfer bias having the low duty and the secondary-transfer bias including only the DC voltage. As the smooth sheet. POD gloss coat 128 having a weight of 129 gsm produced by Oji paper Co., Ltd. was used, in the experiment, a black halftone image (2 by 2) has been secondarily transferred onto the smooth sheet under the conditions that the temperature is 27° C., the humidity is and the process linear velocity is 630 mm/s. The results nave indicated that the black halftone image is secondarily transferred onto the smooth sheet in a successful manner without the secondary transfer failure. The transfer rate of the halftone image significantly increased as compared to the case in which the secondary-transfer bias having the low duty is used.

The reason why secondary transferability of the black halftone image relative to the smooth sheet was improved by using the secondary-transfer bias including, the high duty is as follows. When the intermediate transfer belt 31 that endlessly moves enters the secondary-transfer nip N, the secondary-transfer bias stalls charging a portion of the intermediate transfer belt 31 that has entered the secondary-transfer nip N. When the amount of charge exceeds the threshold value, charges having the opposite polarity start to be injected into the few-dot toner masses in the halftone image. The portion of the intermediate transfer belt 31 having entered the secondary-transfer nip N is charged during the transfer-peak time period tf. Accordingly, with an increase in length of the transfer-peak time period tf, the amount of injection of the charges having the opposite polarity into the few-dot toner masses increases. The secondary-transfer bias having the high duty has a shorter transfer-peak time period tf than the secondary-transfer bias having the low duty. Accordingly, it is conceivable that the secondary-transfer bias having the high duty reduces the amount of injection of the charges having the opposite polarity into the few-dot toner masses, thereby preventing or reducing the occurrence of the secondary transfer failure.

Another experiment performed by the present inventors has indicated as follows. The use of the secondary-transfer bias having the high duly that does not reverse the polarity during one cycle improves the secondary transferability relative to the smooth sheet as compared to the use of the secondary-transfer bias having the high duty that reverses the polarity during one cycle.

The present inventors have considered that reducing the amount of deformation of the elastic layer 31*b* of the intermediate transfer belt 31 in the secondary-transfer nip to a certain degree can increase the transfer rate of the halftone image relative to the smooth sheet.

Accordingly, the present inventors have performed a seventh experiment in which test images were printed using various types of belt having different hardnesses from each other as the intermediate transfer belt 31. The eleven types of belts listed in Table 1 below were used as the intermediate transfer belt 31 in the seventh experiment.

TABLE 1

| | | Elastic Layer | | Hardness | |
|---|---|---|---|---|---|
| Belt | Surface Layer Material | Thickness (μm) | Material | Martens | Micro-Rubber |
| A | No Surface Layer | None | Acrylic Rubber | 240 | 100 |
| B | No Surface Layer | 100 | Acrylic Rubber | 1.4 | 87 |
| C | No Surface Layer | 390 | Acrylic Rubber | 0.31 | 35.9 |
| D | No Surface Layer | 600 | Acrylic Rubber | 0.2 | 25.1 |
| E | Acrylic (Rate 50%) | 390 | Acrylic Rubber | 0.36 | 44.3 |
| F | Acrylic (Rate 60%) | 390 | Acrylic Rubber | 0.4 | 53.5 |

TABLE 1-continued

| Belt | Surface Layer Material | Elastic Layer Thickness (μm) | Elastic Layer Material | Hardness Martens | Hardness Micro-Rubber |
|---|---|---|---|---|---|
| G | Acrylic (Rate 70%) | 390 | Acrylic Rubber | 0.55 | 62.1 |
| H | Acrylic (Rate 80%) | 390 | Acrylic Rubber | 0.65 | 70.6 |
| I | No Surface Layer | 240 | Acrylic Rubber Acrylic Resin 40% | 1.11 | 82.1 |
| J | No Surface Layer | 390 | Acrylic Rubber Acrylic Resin 40% | 0.58 | 70 |
| K | No Surface Layer | 600 | Acrylic Rubber Acrylic Resin 40% | 0.29 | 32 |

In Table 1, the surface layer is a top layer disposed on the elastic layer and has a thickness of 10 μm. Among the eleven types of belts, a belt A through a belt K, the belt A is a single-layer belt without an elastic layer and a surface layer. That is, the belt A is not available as the intermediate transfer belt 31 used in the image forming apparatus according the present embodiment. The belt B through the belt K (ten types of belts) include the elastic layer. Among the belt B through the belt K, the belt E through the belt H (four types of belts) include a top surface on the elastic layer.

The belt B through the belt D and the belt I through the belt K (six types of belts) include only the elastic layer. The belt B through the belt D (three types of belts) employ acryl rubber for an elastic layer material, and the belt I through the belt K (three types of belts) employ a mixture of acryl rubber and acrylic resin for an elastic layer material. With changes in combination of the material and the thickness of the elastic layer, the six types of belts differ in hardness (Martens hardness and micro-rubber hardness) from each other. As represented in Table 1, the belt C, belt E through belt H, and belt J have a common thickness of the elastic layer of 390 μm, and differ in content ratio of acrylic resin in the item of "Surface Layer Material". Thus, the belts have different hardnesses from each other.

In the seventh experiment, a blue solid image and textual image were printed onto the uneven surface sheet (Leathac 66) and a single-color halftone image was printed onto the smooth sheet (POD gloss coat 128) for each use of the eleven types of belts (the belt A through the belt K). When the solid image and textual image were printed in the uneven surface sheet the secondary-transfer bias including the superimposed voltage with the low duty (12%) was used. When the halftone image was printed in the uneven surface sheet, the secondary-transfer bias including the superimposed voltage with the high duty (80%) was used. In both cases, the process linear velocity was set 630 mm/s.

The following lists the conditions for the seventh experiment.

Environment: 23° C. and 50%;

Intermediate transfer belt: belt A through belt K;

Test image: a blue solid image, a black textual image, and a single-color halftone image;

Recording sheet for printing a solid image and a textual image; Leathac 66 having an uneven surface with a basis weight of 215 kg;

Recording sheet for printing a halftone image: POD gloss coat 128;

Secondary transfer bias: the secondary transfer bias including the superimposed voltage;

Frequency f of the above-described secondary transfer bias: 0.8 kHz;

Peak-to-peak potentials Vpp of the above-described secondary-transfer biases: 10 kV;

DC component of the above-described secondary transfer bias (offset voltage Ypff): −5 kV;

Opposite-peak duty of the secondary transfer bias in a use of the uneven surface sheet: 12%;

Opposite-peak duty of the secondary transfer bias in a use of the coaled paper: 80%; and Process linear velocity: 630 mm/s.

Figure 15:
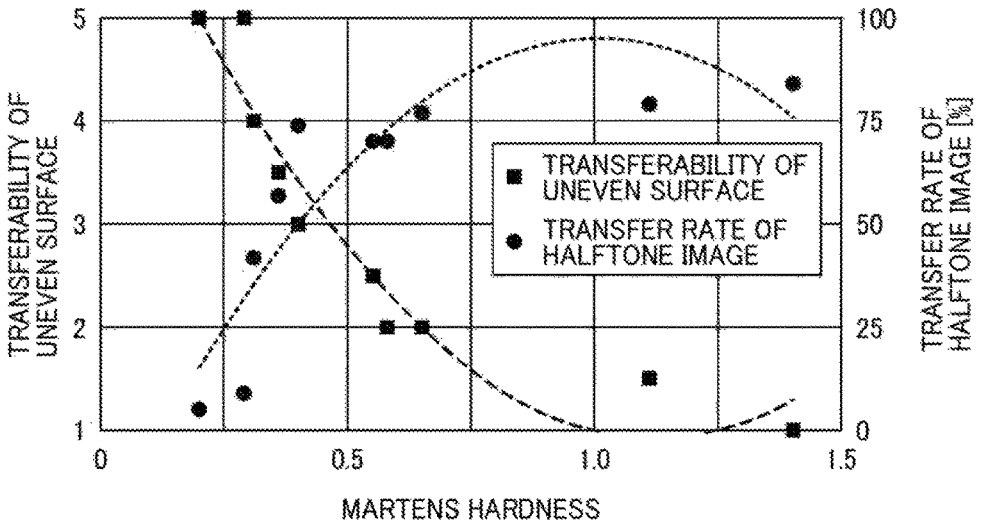
FIG. 15 is a graph of the relations of a Martens hardness of an intermediate transfer belt, the transferability of a solid image in recesses of an uneven surface sheet, and the transfer rate of a halftone image relative to a smooth sheet in a seventh experiment.
Figure 16:
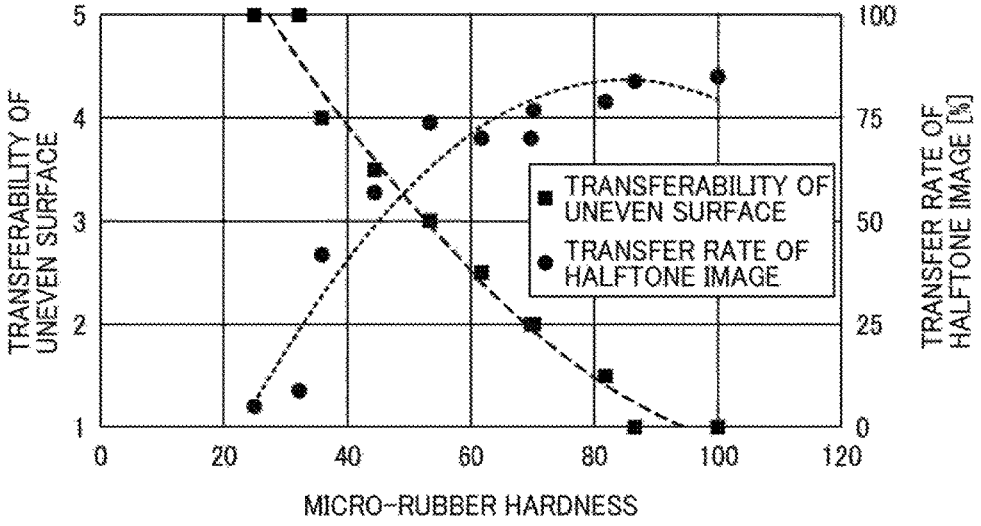
FIG. 16 is a graph of the relations of a micro-rubber hardness of the intermediate transfer belt, the transferability of a solid image in recesses of an uneven surface sheet, and the transfer rate of a halftone image relative to a smooth sheet in the seventh experiment.

FIG. 15 is a graph of the relations between the Martens hardness of an intermediate transfer belt, the transferability of a solid image in recesses of an uneven surface sheet, and the transfer rate of a halftone image relative to a smooth sheet in the seventh experiment. FIG. 16 is a graph of the relations between the Martens hardness of an intermediate transfer belt, the transferability of a solid image in recesses of an uneven surface sheet, and the transfer rate of a halftone image relative to a smooth sheet in the sixth experiment. Note that the Martens hardness is the hardness in the vicinity of the surface of the intermediate transfer belt and the micro-rubber hardness is the hardness of the entire thickness of the intermediate transfer belt.

As can be found from FIG. 15 and FIG. 16, with a reduction in Martens hardness and micro-rubber hardness of the intermediate transfer belt 31, the transferability in unevenness of the uneven surface sheet increases, but the transfer rate of the halftone image relative to the smooth sheet decreases. The transferability in unevenness of the uneven surface sheet and the transferability of the halftone image relative to the smooth sheet make a trade-off therebetween. With a reduction in hardness of the intermediate transfer belt 31, the elastic layer 31*b* favorably deforms, thereby reducing the distance between the bottom of the recesses of the uneven surface sheet and the surface of the intermediate transfer belt, thus increasing the transferability in unevenness of the uneven surface sheet. However, the surface of the intermediate transfer belt covers few-dot toner masses on the smooth sheet in a further degree, thereby increasing the amount of injection of charges having an opposite polarity into toner, thus reducing the transferability of the halftone image. Exchanging the intermediate transfer belt 31 according to the type of the recording sheet is difficult. Thus, the hardness of the intermediate transfer belt 31 is preferably adjusted according to the transfer rate of the halftone image and the transferability in unevenness.

Table 2-1 and Table 2-2 below represent the hardness of the intermediate transfer belt 31 and the evaluation results of image quality in the seventh experiment. Note that the text scattering is the phenomenon in which toner scatters around the textual image transferred onto the uneven surface sheet. Such a text scattering is more likely to occur when the secondary-transfer bias of the superimposed voltage including the AC component as compared to the case in which the secondary transfer bias including only the DC voltage is used. The occurrence of the white spot is the phenomenon in which a lot of white spots occur in an image due to the electric discharge generated in the secondary-transfer nip.

TABLE 2-1

| Belt | Elastic Layer Thickness (μm) | Martens | Micro-Rubber | Halftone Transfer Rate (%) | Solid Transferability in Unevenness |
|---|---|---|---|---|---|
| | | | | Opposite-Peak Duty (%) | |
| | | | | 80 | 80 |
| | | | | Type of Recording Sheet | |
| | | | | Coated Paper | Uneven Surface Paper |
| | | | | Belt Hardness/Image | |
| D | 600 | 0.2 | 25.1 | 5 | 5 |
| K | 600 | 0.29 | 32 | 9 | 5 |
| C | 390 | 0.31 | 35.9 | 42 | 4 |
| E | 390 | 0.36 | 44.3 | 57 | 3.5 |
| F | 390 | 0.4 | 53.5 | 74 | 3 |
| G | 390 | 0.55 | 62.1 | 70 | 2.5 |
| I | 390 | 0.58 | 70 | 70 | 2 |
| H | 390 | 0.65 | 70.6 | 77 | 2 |
| J | 240 | 1.11 | 82.1 | 79 | 1.5 |
| B | 100 | 1.4 | 87 | 84 | 1 |
| A | None | 240 | 100 | 85 | 1 |
| | | | | | Image Evaluation Grade |

TABLE 2-2

| Belt | Elastic Layer Thickness (μm) | Martens | Micro-Rubber | Solid Transferability in Unevenness | Solid Text Scattering | Solid White Spots |
|---|---|---|---|---|---|---|
| | Elastic | Opposite-Peak Duty (%) | | 12 | 12 | 12 |
| | | | | Uneven Surface Paper | | |
| | Layer | Type of Recording Sheet | | Solid | Solid | Solid |
| | Thickness | Belt Hardness/Image | | Transferability | Text | White |
| D | 600 | 0.2 | 25.1 | 5 | 4 | 4.5 |
| K | 600 | 0.29 | 32 | 5 | 4 | 4 |
| C | 390 | 0.31 | 35.9 | 5 | 4 | 4 |
| E | 390 | 0.36 | 44.3 | 4.5 | 4 | 4 |
| F | 390 | 0.4 | 53.5 | 4.5 | 3.5 | 3.5 |
| G | 390 | 0.55 | 62.1 | 4 | 3.5 | 3.5 |
| I | 390 | 0.58 | 70 | 4 | 3 | 3 |
| H | 390 | 0.65 | 70.6 | 4 | 2.5 | 3 |
| J | 240 | 1.11 | 82.1 | 4 | 2.5 | 2.5 |
| B | 100 | 1.4 | 87 | 3.5 | 2 | 2 |
| A | None | 240 | 100 | 3 | 2 | 2 |
| | | | | Image Evaluation Grade | | |

Table 2-1 and Table 2-2 lists the hardnesses of the belts in ascending order, in other words, the hardness of belt D is the lowest, and the hardness of belt A is the highest as represented in Table 2-1 and Table 2-2. It is preferable that the intermediate transfer belt 31 has hardness within the range of the hardnesses of belt C through belt I listed in Table 2-1 and Table 2-2 in a comprehensive view of the evaluation for the transfer rate of the halftone image relative to the smooth sheet, the transferability in unevenness, the text scattering, and the white spot. More specifically, the micro-rubber hardness ranges from 36 through 82, and the Martens hardness ranges from 0.3 through 1.1.

When the thickness of the elastic layer 31*b* is increased to 600 μm, the transfer rate of the halftone image significantly decreases. However, with the secondary transfer bias having the low duty employed, the transferability in unevenness within the permissible range can be obtained even when the thickness of the elastic layer 31*b* is increased to approximately 390 μm. Thus, the thickness of the elastic layer 31*b* is preferably less than or equal to 390 μm.

Next, the present inventors have performed an eight experiment of investigating the secondary transferability by secondarily transferring a halftone image onto a smooth sheet with the secondary transfer bias including only the DC voltage, by using the eleven types of intermediate transfer belts used in the seventh experiment.

The following lists the conditions for the eighth experiment.

Environment: 23° C. and 50%;

Intermediate transfer belt: belt A through belt K;

Test image: a single-color halftone image;

Recording sheet onto which the halftone image is transferred: POD gloss coat 125;

Secondary transfer bias: the secondary transfer bias including only the DC voltage; and Process linear velocity: 630 mm/s.

Results of the eighth experiment are listed in Table 3.

TABLE 3

| Belt | Elastic Layer Thickness (μm) | Martens | Micro-Rubber | DC Voltage (−5 kV) Only Coated Paper Halftone Transfer Rate (%) |
|---|---|---|---|---|
| | | Secondary Transfer Bias | | |
| | | Type of Recording Sheet | | |
| | | Belt Hardness/Image | | |
| D | 600 | 0.2 | 25.1 | 2 |
| K | 600 | 0.29 | 32 | 4 |

TABLE 3-continued

| Belt | Elastic Layer Thickness (μm) | Martens | Micro-Rubber | DC Voltage (−5 kV) Only Coated Paper Halftone Transfer Rate (%) |
|---|---|---|---|---|
| | | Secondary Transfer Bias | | |
| | | Type of Recording Sheet | | |
| | | Belt Hardness/Image | | |
| C | 390 | 0.31 | 35.9 | 15 |
| E | 390 | 0.36 | 44.3 | 20 |
| F | 390 | 0.4 | 53.5 | 37 |
| G | 390 | 0.55 | 62.1 | 44 |
| I | 390 | 0.58 | 70 | 56 |
| H | 390 | 0.65 | 70.6 | 57 |
| J | 240 | 1.11 | 82.1 | 68 |
| B | 100 | 1.4 | 87 | 78 |
| A | None | 240 | 100 | 82 |

Figure 17:
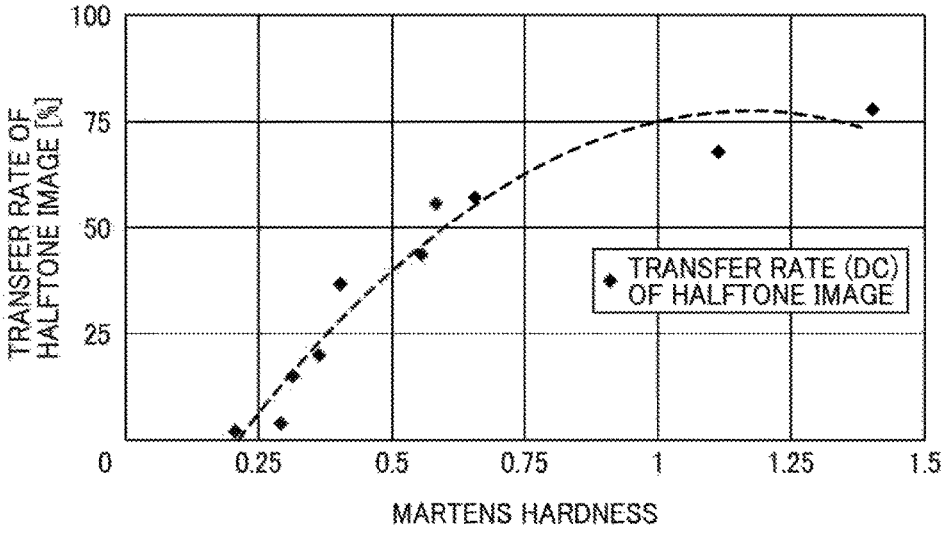
FIG. 17 is a graph of the relations of a Martens hardness of an intermediate transfer belt and the transfer rate of a halftone image relative to a smooth sheet in an eighth experiment.
Figure 18:
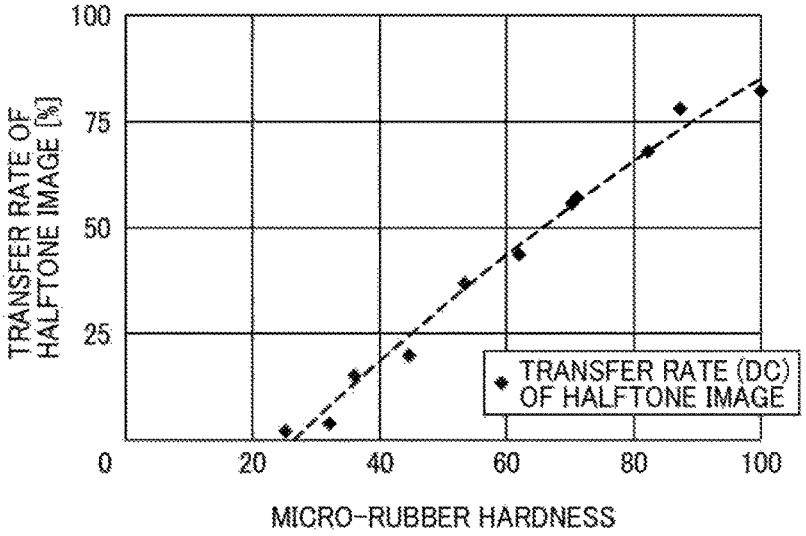
FIG. 18 is a graph of the relations of a micro-rubber hardness of an intermediate transfer belt and the transfer rate of a halftone image relative to a smooth sheet in the eighth experiment.

FIG. 17 is a graph of the relations between a Martens hardness of an intermediate transfer belt and the transfer rate of a halftone image relative to a smooth sheet in an eighth experiment. FIG. 18 is a graph of the relations between a micro-rubber hardness of an intermediate transfer belt and the transfer rate of a halftone image relative to a smooth sheet in the eighth experiment.

As can be seen from the comparison between Table 2-1 and Table 2-2 (FIG. 15 and FIG. 16) and Table 3, the transfer rate of the halftone image relative to the smooth sheet in the seventh experiment is higher than the transferability of the halftone image relative to the smooth sheet in the eighth experiment when the intermediate transfer belt has the common hardness. When the intermediate transfer belt has the common hardness, the transfer rate of the halftone image relative to the smooth sheet with the secondary transfer bias of the high duty including the superimposed voltage increases as compared to the case in which the secondary transfer bias including only the DC voltage is used. When the intermediate transfer belt has the common hardness, the transfer rate of the halftone image relative to the smooth sheet with the secondary transfer bias of the high duty including the superimposed voltage increases as compared to the case in which the secondary transfer bias including only the DC voltage is used. Thus, the intermediate transfer belt 31 is preferably soft sufficient to achieve a favorable transferability in unevenness in the mode of forming an image in the uneven surface sheet, but is not too soft. The use of the secondary transfer bias including only the DC voltage in the mode of forming an image in the smooth sheet has the following advantageous effects as compared to the case of using the secondary transfer bias including the superimposed voltage. The electrical load on the secondary-transfer first roller 33 and the intermediate transfer belt 31 can be reduced, thereby increasing the longevity thereof.

Figure 19:
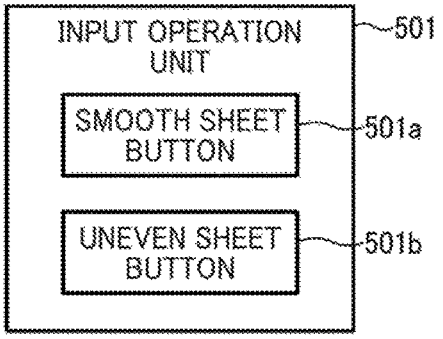
FIG. 19 is a block diagram of electrical circuitry of an input operation unit of the image forming apparatus according to an embodiment of the present disclosure.

FIG. 10 is a block diagram of electrical circuitry of an input operation unit 501 of the image forming apparatus according to the embodiment of the present disclosure. As illustrated in FIG. 19, the input operation unit 105 includes a smooth sheet button 501*a* and an uneven sheet button 501*b*. In the image forming apparatus according to the embodiment a description is given in the instruction manual tor uses to operate as follows. That is, when a highly-smooth sheet having a good surface smoothness, such as a coated sheet, as a recording sheet P is set in the sheet tray 100 of FIG. 1, the smooth sheet button 501*a* is depressed. By contrast, when a low-smooth sheet that is inferior in surface smoothness, such as a regular paper or Japanese paper, as a recording sheet P is set in the sheet tray 100. the uneven sheet button 501*b* is depressed. That is, the input operation unit 501 functions as an information acquisition device that acquires the following information. Specifically, the specific information includes information capable of specifying whether a recording sheet P subjected to the secondary transfer of the toner image is a high-smooth sheet having a good surface smoothness or a low-smooth sheet that is inferior in surface smoothness to the high-smooth sheet.

The power-source controller 200 as a controller switches a transfer mode between a high-smooth mode (first mode) to secondarily transfer a toner image onto the high-smooth sheet and a low-smooth mode (second mode) to secondarily transfer a toner image onto the low-smooth sheet based on the information obtained by the input operation unit 501. More specifically, when the smooth sheet button 501*a* is depressed, the power-source controller 200 switches the transfer mode to the high-smooth mode. In the high-smooth mode, the secondary-transfer power source 39 outputs the secondary-transfer bias having the high duty 10 prevent or reduce the injection of the charges having, the opposite polarity into the few-dot toner masses in a secondary transfer of the halftone image onto the smooth sheet, in the secondary-transfer bias used in the high-smooth mode, the polarity is constantly negative (is not reversed), and the opposite-peak duty ranges from 70% to 90%.

When the uneven sheet button 501*b* is depressed, the power-source controller 200 switches the transfer mode to the low-smooth mode. In the low-smooth mode, the secondary transfer power source 39 outputs the secondary transfer bias having the low duty to secondarily transfer a sufficient amount of toner into the recesses of the uneven surface sheet. The secondary-transfer bias has the following property. The secondary-transfer bias reverses the polarity between the negative polarity and the positive polarity during one cycle. In the negative polarity, the polarity of the average potential Vave and the polarity of the transfer peak value Vt are negative in which the direction of the electrical field is in the transfer direction. In the positive polarity, the polarity of the opposite-peak value Vr is positive in which the direction of the electrical field is opposite to the transfer direction. In addition, the opposite-peak duty ranges from 8% to 11%.

Such a configuration, in which the secondary-transfer power source 39 outputs the secondary-transfer bias having the low duty with the use of the low-smooth sheet, such as a regular paper or Japanese paper, as the recording sheet, exhibits the following effects. The toner particles favorably reciprocate in the secondary transfer nip between the recesses of the recording sheet P and the surface of the intermediate transfer belt 31, thereby transferring a sufficient amount of toner onto the recesses of the recording sheet P, thus preventing or reducing the occurrence of unevenness in image density in conformity with the uneven surface. Thus, with the opposite-peak duty being low duty, the occurrence of white spots due to the electrical discharge is prevented or reduced.

When the high-smooth sheet, such as a coated paper, is used as a recording sheet, the secondary-transfer power source 39 outputs the secondary-transfer bias having the high duty. This exhibits the following advantageous effects. With the opposite-peak duty being the high duty, the injection of the charges having the opposite polarity into the few-dot toner groups of the halftone image is prevented or reduced, thereby increasing the secondary transferability of the halftone image relative to the smooth sheet. Thus, the occurrence of insufficient image density of the halftone image is prevented.

In the high-smooth mode, the secondary transfer bias having the low duty may be used instead of the secondary transfer bias having the high duty. The secondary transfer bias having the low duty can increase the transfer rate of the halftone image relative to the high-smooth sheet as compared to the secondary transfer bias including only the DC voltage. When the intermediate transfer belt 31 is soft sufficient, to achieve a favorable transferability in unevenness in the low-smooth mode and is not too soft to obtain a permissible transfer rate of the halftone image in the high-smooth mode, the secondary transfer bias including only the DC voltage maybe used instead of the secondary transfer bias having the high duty.

Next, a description will be given of image forming apparatus according to Examples in which a more specific configuration is applied to the image forming apparatus according to the embodiment. Furthermore, the configuration of the image forming; apparatus according to Examples is the same as in the embodiment unless otherwise stated.

Figure 20:
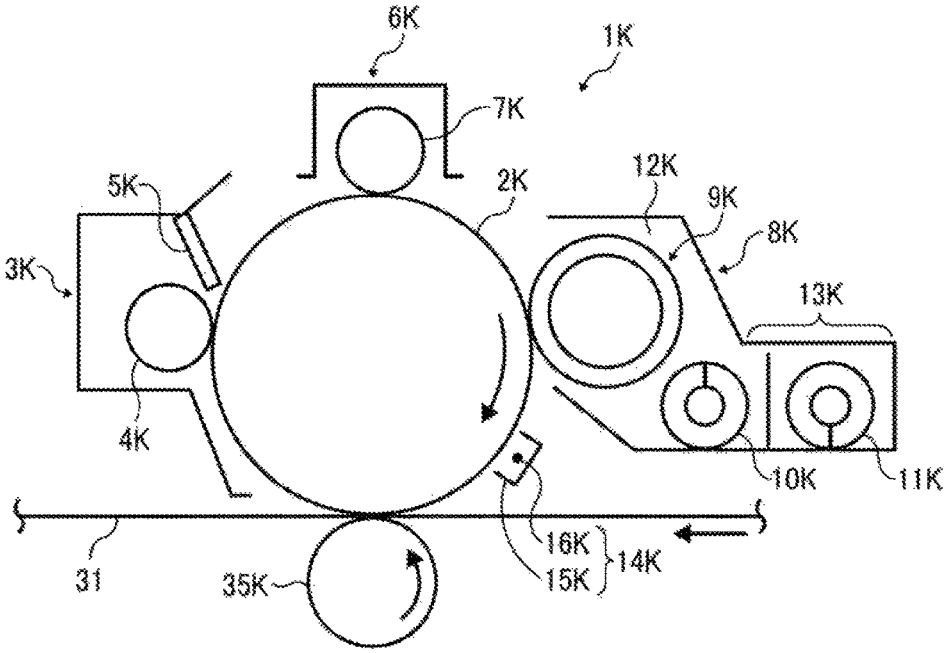
FIG. 20 is a schematic view of an image forming unit for the color black as a representative example of image forming units employed in the image forming apparatus according to Examples.

FIG. 20 is a schematic view of an image forming unit for a black color as a representative example of image forming units employed in the image forming apparatus according to Examples, The toner image forming unit 1K includes a charger 14K. The charger 14K includes a housing 15K and a corona discharger. The housing 15K has an opening opposed to the photoconductor 2K The corona discharger includes a corona wire 16K that is stretched out within the housing 15K. A voltage ranging from −3.5 kV through −8 kV and preferably from −4.0 kV through −5.5 kV is applied to the corona wire 16K having tungsten wire plated with gold and the photoconductor 2K, and a corona discharge occurs between the corona wire 16K and the photoconductor 2K. In this case, the current value ranges from −300 μA through −1000 μA.

The charger 14K is disposed to face an area downstream from a position opposed to the developing roller 9K and upstream from the primary-transfer nip for black color in the circumferential surface of the photoconductor 2K. The above-described corona discharge supplies charges having the same polarity as the normal charge polarity (the negative polarity in the present Example) to the black toner image borne on the area. This increases the toner charge amount (Q/M (mass-to-charge ratio)) of the black toner image having been developed on the photoconductor 2K before the black toner image enters the primary-transfer nip. With such an increase in toner charge amount of the black toner image, the toner charge amount of the black toner image that has been primarily transferred from the photoconductor 2K onto the intermediate transfer belt 31 increases as compared to the case without charging of the charger 14K. Such a configuration increase the toner charge amount of the black halftone image that is secondarily transferred onto the high-smooth sheet in the secondary-transfer nip as compared to the ease without charging of the charger 14K. Thus, the occurrence of insufficient image density of the halftone image due to the injection of charges having the opposite polarity into the black halftone image in the secondary-transfer nip is prevented. In other words, in addition to the way to prevent excessively reducing the hardness of the intermediate transfer belt 31 to prevent the occurrence of insufficient image density of the black halftone image due to the injection of charges having, the opposite polarity into the black halftone image, the charger 14K may be employed to supply charges to the toner image. With an increase in degree of freedom for the range of the hardness of the intermediate transfer belt 31, the transferability of the halftone image relative to the high-smooth sheet and the transferability of an image relative to the uneven surface sheet are more likely to increase.

Note that the secondary transferability of the black halftone image relative to the high-smooth sheet tends to be worst among the four colors of yellow, magenta, cyan, and black. The reason is as follows. Among the yellow toner, the magenta toner, the cyan toner, and the black toner, only the black toner contains carbon black as coloring material, and tints the volume resistivity of the black toner becomes the lowest, resulting in the toner charge amount of the black halftone image becoming the lowest. As the volume resistivity decreases, the toner charge amount decreases. This is supposed to occur because a reduction in volume resistance causes a reduction in apparent electrostatic capacity.

Among the toner image forming units 1Y, 1M, 1C, and 1K, at least the toner image forming unit 1K for black color includes the charger 14K. Whether a charger is to be provided for the toner image forming units 1M, 1C, and 1K is preferably considered based on the secondary transferability of the halftone image.

A charter may be provided for each of the toner image forming units 1M, 1C, and 1K. Alternatively, a charger may be provided for one of the toner image forming units 1M, 1C, and 1K. The toner charge amount of a toner image immediately before the toner image enters the secondary-transfer nip typically increases in order of yellow, magenta, and cyan. The reason why the charge amount of the yellow toner in the yellow toner image becomes the greatest among, toner images of other colors is that the number of times of passing the downstream side primary transfer nips. More specifically, the yellow toner image enters the downstream side primary transfer nips, i.e., the primary transfer nips for magenta, cyan, and black, before entering the secondary-transfer nip, and the charges having the normal charge polarity are injected to the toner images of the respective colors in the primary-transfer nips. That is, the yellow toner image is the greatest receives the injection of the charges having the normal charge polarity in the downstream primary-transfer nip three times, and thus the amount of injection of the charges into the yellow toner image is the greatest receives the injection of the charges having the normal charge polarity in the downstream primary-transfer nip three times, which is the largest among the three colors of magenta, cyan, and black. Accordingly, the toner charge amount of the yellow toner image is the greatest among magenta, cyan, and black. Thus, the degree of demand for provision of the charger has the relations of K>C>M>Y.

Hereinafter, a charger providing charges having the normal charge polarity to a toner image before the toner image enters the secondary-transfer nip is referred to as "precharge". In the image forming apparatus according to the present Example, a charger providing charges to a toner image on the surface of the photoconductor 2 is referred to as "precharge on photoconductor". Unlike in the image forming apparatus according to the present Example, a charger providing charges to a toner image on the surface of the intermediate transfer belt 31 is referred to as "precharge on belt".

The present inventors have performed a ninth experiment of investigating a relationship between a precharge method, types of images, a secondary transfer rate of toner onto a high-smooth sheet by using the above-described prototype image forming apparatus.

Figure 21:
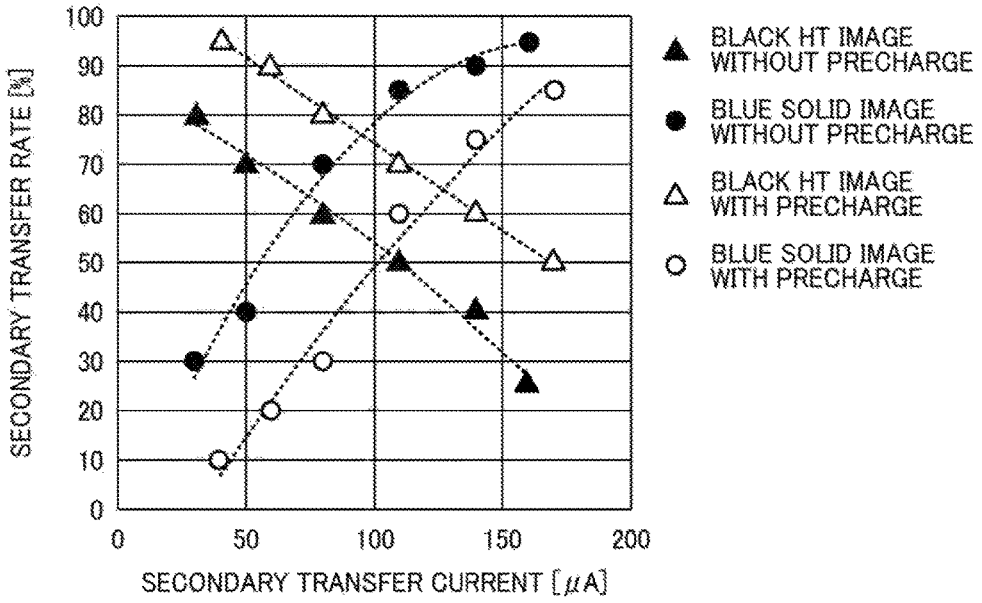
FIG. 21 is a graph of the relations of the secondary-transfer rate, the secondary transfer current, and a type of an image when a pre charge is provided on a belt as a precharge method.

FIG. 21 is a graph of the relations of the secondary-transfer rate, the secondary-transfer current, and a type of an image when a precharge is provided on a belt as a precharge method. In FIG. 21, the blue solid image is a solid image in which a magenta solid image is superimposed on a cyan solid image. The "HT image" refers to a halftone image.

The secondary-transfer rate of the black halftone image decreases with an increase in secondary transfer current. In contrast, the secondary-transfer rate of the blue solid image increases with an increase in secondary transfer current. To obtain a favorable secondary-transfer rate for the black halftone image and the blue solid image to a certain degree, a target value of the secondary transfer current under the constant current control is preferably set to an appropriate value.

In FIG. 21, when the amount of the secondary transfer current to obtain the same value of the secondary-transfer rate of the black halftone image is compared between the case of performing the precharge on belt and the case without the precharge on belt. In FIG. 21, when the amount of the secondary transfer current to obtain the same value of the secondary-transfer rate of the black halftone image is compared between the case of performing the precharge on belt and the case without the precharge on belt, the amount of the secondary-transfer current in the ease of performing the precharge on belt is greater than the amount in the case without the precharge on belt. In FIG. 21, when the amount of the secondary transfer current to obtain the same value of the secondary-transfer rate of the black halftone image is compared between the case of performing the precharge on belt and the case without the precharge on belt, the amount of the secondary-transfer current in the case of performing the precharge on belt is greater than the amount in the case without the operation of the precharge on belt. This means that the difference in secondary-transfer rate between the black halftone image and the blue solid image is substantially the same between the case of performing the precharge on belt and the case without the precharge on belt.

For example, when the precharge on belt is performed, the secondary-transfer rates of the blue solid image and the black halftone image with the secondary transfer current having a control target value of 170 μA are 85% and 50%, respectively. Thus, the difference in secondary-transfer rate is 35%. For example, when the precharge on belt is not performed, the secondary-transfer rates of the blue solid image and the black halftone image with the secondary transfer current having a control target value of 110 μA are 85% and 50%. respectively. In this ease as well the difference in secondary-transfer rate is 35%.

Thus, the configuration, in which the precharge on belt is performed to supply charges to a toner image before the secondary transfer of the toner image, has a difficulty in increasing the secondary-transfer rate of a halftone image relative to a high-smooth sheet even with the precharge performed. This is because the operation of the precharge on belt supplies charges to both toner constituting the halftone image and tone constituting the solid image, which unsuccessfully increases an appropriate value of the secondary transfer current for each of the halftone image avid the solid image.

Figure 22:
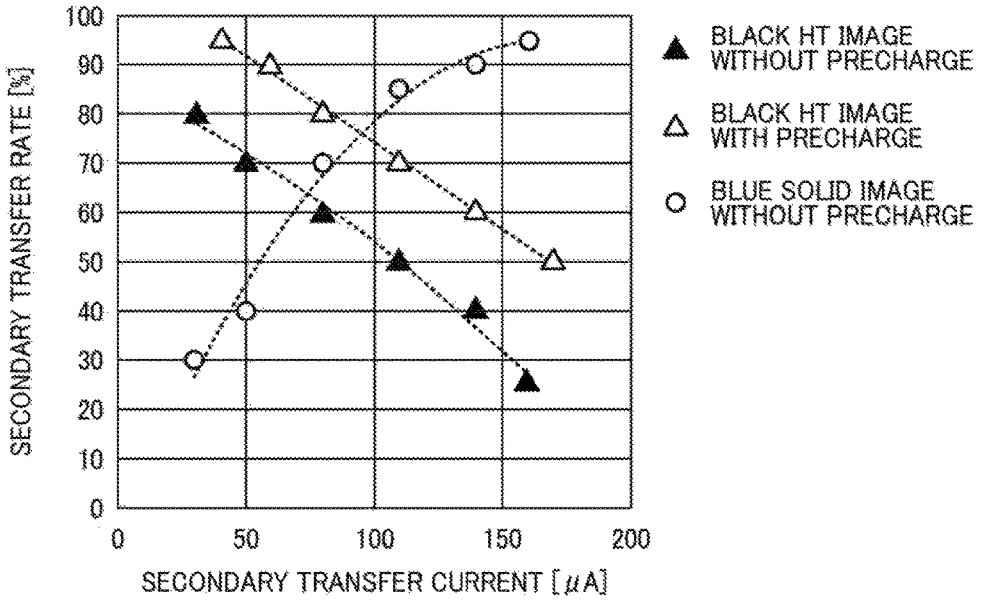
FIG. 22 is a graph of the relations of the secondary-transfer rate, the secondary transfer current, and a type of an image when a precharge is provided on a photoconductor as another precharge method.

FIG. 22 is a graph of the relations between the secondary-transfer rate, the secondary transfer current (target value under constant current control), and a type of an image when a precharge is provided on a photoconductor (the operation of the precharge on photoconductor is performed) as another precharge method in the same manner as in the image forming apparatus according to the Example. In the present example, the operation of the precharge on photoconductor is performed on the photo-conductor 2K only, and not performed on the other photoconductors.

In FIG. 22, when the amount of the secondary transfer current to obtain the same value of the secondary-transfer rate of the black halftone image is compared between the case of performing the precharge on photoconductor and the case without the operation of the precharge on photoconductor.

FIG. 22 represents the aspect of the blue solid image with the operation of the precharge on photoconductor, and does not represent the aspect of the blue solid image without the operation of the precharge on photoconductor. The reason is as follows. The blue solid image is a solid image in which a magenta solid image is superimposed on a cyan solid image. Any charger is not disposed in the toner image forming, unit 1M for forming, a magenta solid image and the toner image forming unit 1C for forming a cyan solid image. Accordingly, the magenta solid image and the cyan solid image enter the secondary-transfer nip without being precharged irrespective of performing the operation of the precharge on photoconductor during the formation of the halftone image in the toner image forming unit 1K. In other words, irrespective of whether or not the precharge on photoconductor is performed relative to the black halftone image, a blue solid image and any single-color toner image other than the black toner image (a toner image in which any single-color toner images other than the black toner image are superimposed on each other) are not precharged. Thus, the blue solid image is not precharged in FIG. 22.

In such a configuration, when the photoconductor 2K for black color is precharged and the amount of the secondary-transfer current is increased to obtain the same secondary-transfer rate for black, the secondary-transfer rates for yellow, magenta, and cyan increase as a result. This means that the difference in secondary-transfer rate between the black halftone image and the blue solid image significantly differs between the case of performing the precharge on photoconductor and the case without the operation of the precharge or photoconductor.

For example, the secondary transfer current is preferably set to have a control target value of approximately 110 μA to obtain the secondary-transfer rate of for the blue solid image. With the secondary transfer current having a control target value of approximately 110 μA, the secondary-transfer rate of the black halftone image is 50% in the case without the operation of the precharge on photoconductor, and is increased to 70% when the photoconductor 2K for black is precharged. Thus, as the precharge method, the operation of the precharge on photoconductor, instead of the precharge on belt, is preferably performed to increase the secondary-transfer rate of the halftone image.

Note that even when a charger for supplying charges to a toner linage on the photoconductor 2 is disposed on each of the toner image forming units 1Y, 1M, 1C, and 1K, the operation of the precharge on photoconductor exhibits advantageous effects unlike in the precharge on belt. This is because the respective charge supply amounts can be changed with the chargers for some or all of the colors, yellow, magenta, cyan, and black unlike in the operation of the precharge on belt that uniforms the charge supply amounts for all the colors As a result, advantageous effects can be obtained by performing the precharge on photoconductor.

Next, a description is given of the image forming apparatus according to each specific Example in which a more specific configuration is applied to the image forming apparatus according to the Example. Furthermore, the configuration of the image forming apparatus according to each specific Example is the same as in the configuration according to the Example unless otherwise stated.

[First Specific Example]

Figure 23:
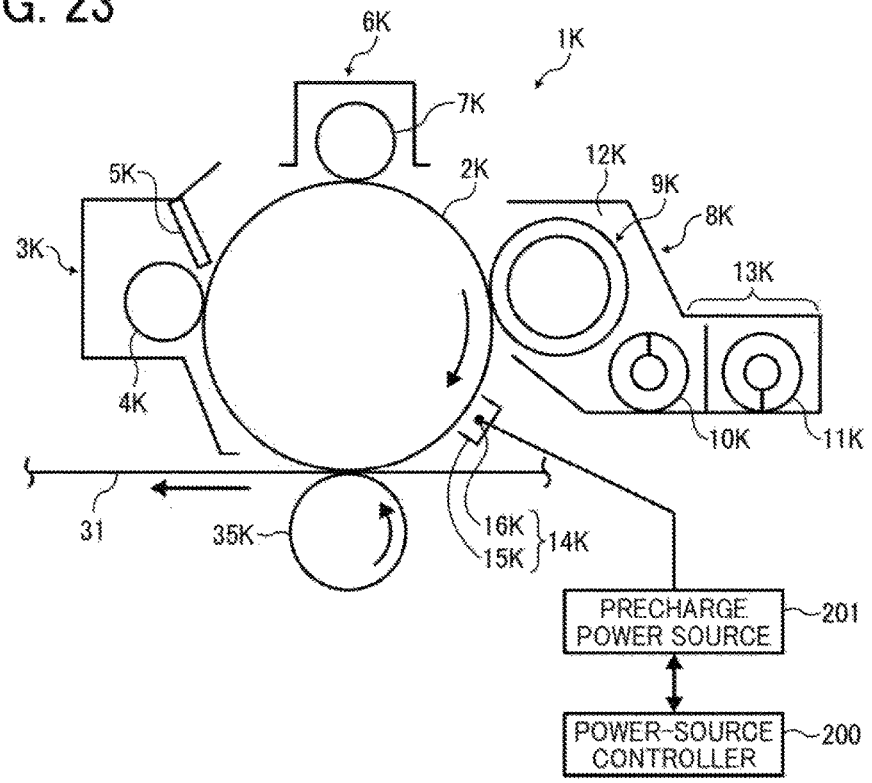
FIG. 23 is a schematic view of the toner image forming unit for the black color employed in an image forming apparatus according to a first Example, together with a power-source controller and a precharge power source.

FIG. 23 is a schematic view of the toner image forming unit 1K for the black color employed in an image forming apparatus according to a first specific Example, together with a power-source controller 200 and a precharge power source 201. The precharge power source 201 outputs charge bias including the DC voltage that is applied to the charger 14K. The power-source controller 200 controls the output of the charge bias of the precharge power source 201.

As in the image forming apparatus according to the above-described Example, the configuration that performs the operation of the precharge on photoconductor can increase the transferability of toner relative to the uneven surface sheet with the use of the intermediate transfer belt 31 having a relatively reduced hardness, and further increase the transferability of a halftone image relative to the smooth sheet with the operation of precharge. When the absolute value of the charge bias applied to the charger 14K is excessively increased, the toner scattering, in which loner scatters around an image area when the charger 14K. supplies charges to a black toner image, occurs, resulting in a reduction in image quality.

The use of the smooth sheet, such as a coated paper, has difficulties in achieving a favorable transfer rate for the halftone image. However, any deterioration in transferability of the halftone image is not recognized in the use of a plain sheet, such as an uneven surface sheet or plain paper (high quality sheet). For this reason, the precharge on photoconductor is preferably performed in the use of the smooth sheet, but is not necessarily performed in the use of a different type of recording sheet than the smooth sheet.

The power-source controller 200 controls the precharge power source 201 to output the charge bias to the charger 14K in response to a pressing operation of the smooth-sheet button (501*a* of FIG. 10) of a user (the high-smooth mode). In such a configuration, the precharge on photoconductor is not performed in the low-smooth mode, in which non-smooth sheet as the recording sheet is used, thus preventing the occurrence of toner scattering.

[Second Specific Example]

In the image forming apparatus according to a second specific Example, the power-source controller 200 controls the precharge power source 201 to output charge bias.

Figure 24:
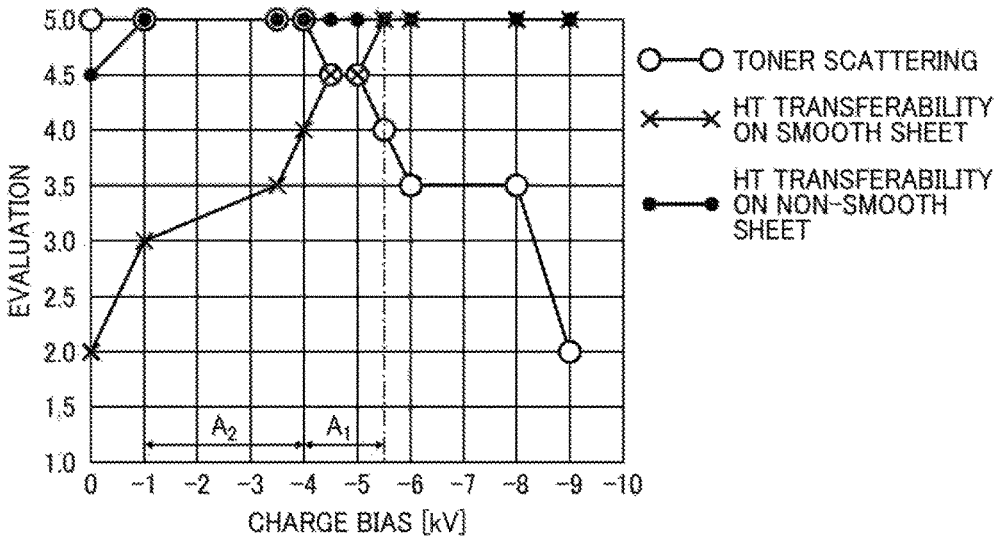
FIG. 24 is a graph of the relations between the evaluation grade of image quality and charge bias applied to the charger.

FIG. 24 is a graph of the relations between the evaluation grade of image quality and the charge bias including the DC voltage to be applied to the charger 14K. The image quality is evaluated for the toner scattering, the transferability of the halftone image relative to the smooth sheet, and the transferability of the halftone image relative to non-smooth sheet.

The toner scattering was evaluated on 5-point scales ranging from Grade 1 through Grade 5, and the evaluation results are plotted in the graph. Grade 5 indicates that no toner scattering occurred, and Grade 4 indicates that the occurrence of toner scattering was slightly noticed. Grade 3 indicates that the occurrence of toner scattering was noticed and Grade 2 indicates that toner substantially scatters around. Grade 1 indicates that toner more substantially scatters around than in Grade 2. The evaluation result is preferably Grade 4 or more. In the present example, a patch image of 20 mm square with a toner amount of 400% (a solid image in which a toner image for each color component is 101%) were formed. Further, two types of recording sheets, a smooth sheet and a non-smooth sheet were used in the present Example. The evaluation resells for toner scattering were the same between the smooth sheet and the non-smooth sheet under the same conditions for the charge bias.

The transferability of the halftone image was evaluated on 5-point scales ranging from Grade 1 through Grade 5, and the evaluation results are plotted in the graph. Grade 5 indicates that no reduction in density was found, and Grade 4 indicates that the density is slightly reduced. Grade 3 indicates that the density is reduced, and Grade 2 indicates that the density is significantly reduced. Grade 1 indicates that most of the toner fails to be transferred. The evaluation result is preferably Grade 4 or more. A halftone image in which 2×2 dots represent halftone in a single color of black was formed.

As the smooth sheet, POD gloss coat 128 having a weighs of 128 gsm that is a gloss-coated paper was used in the experiment, the results of which are represented in FIG. 24. As the non-smooth sheet, Ricoh Type 6000 having a weight of 80 gsm that is plain paper was used.

As illustrated in FIG. 24, with an increase in absolute value of the charge bias, the value of Grade for the toner scattering decreases (the toner scattering deteriorates). Such a phenomenon occurs in both cases of using the non-smooth sheet and the smooth sheet.

In the use of the non-smooth sheet (plain paper), the transferability of the halftone linage can be maintained at Grade 5 that is highest, even with the absolute value of the charge bias significantly increased. However, when the absolute value of the charge bias is excessively reduced, the transferability of the halftone image decreases to Grade 4.5. In the low-smooth mode in which the non-smooth sheet is used, the charge bias is preferably adjusted to range from −1 kV through −4 kV as indicated by the symbol A2 in FIG. 24 to achieve Grade 5 for the transferability of the halftone image.

in the use of the smooth sheet (gloss-coated paper), as the absolute value of the charge bias decreases, the value of Grade for the transferability of the halftone image decreases (the transferability deteriorates). In the high-smooth mode in which the smooth sheet is used, the charge bias is preferably adjusted to range from −4 kV through −5.5 kV as indicated by the symbol A1 in FIG. 24 to achieve Grade 4 or more for the transferability of the halftone image.

In view of the above, the power-source controller 200 controls the precharge power source 201 as follows. When a user presses the smooth sheet button 501*a* to give an instruction for the high-smooth mode, the power-source controller 200 controls the precharge power source 201 to output the charge bias having a greater absolute value in the high-smooth mode than the absolute value in the low-smooth mode, for which the user presses the uneven sheet button 501*b*. In such a configuration, the precharge on photoconductor is not performed in the low-smooth mode, in which non-smooth sheet as the recording sheet is used, thus preventing the occurrence of toner scattering.

Note that, in the image forming apparatus according to the first specific Example and the second specific Example, the opposite-peak duty of the secondary-transfer bias in the low-smooth mode is not limited to less than 50%. The secondary transfer bias including only the DC voltage may be employed in the low-smooth mode. Alternatively, the superimposed voltage having the opposite-peak duty of greater than or equal to 50% may be employed. Thus, the image forming apparatus of the present disclosure may include the following configuration.

The image forming apparatus includes an image bearer (for example, photoconductors 2Y, 2M, 2C, and 2K); a charger (for example, a charger) to supply charges having the same polarity as the normal charge polarity of toner on the image bearer; an intermediate transferor (for example, the intermediate transfer belt 31) having a micro-rubber hardness of less than 100 onto which a toner image is transferred from the image bearer, a nip formation member (for example, the sheet conveyor belt 41) to form a transfer nip (for example, secondary-transfer nip N) between the intermediate transferor and the nip formation member; a transfer power source (for example, the secondary-transfer power source 39) to output a transfer bias (for example, the transfer bias including only the DC voltage to transfer the toner image from the intermediate transferor onto a recording sheet disposed in the transfer nip between the intermediate transferor and the nip formation member; an information acquisition unit (for example, the input operation unit ) to acquire information regarding a surface smoothness of the recording sheet that is a transfer target of the toner image; a controller (for example, the power-source controller 200) to control the charger based on the information acquired by the information acquisition unit. The controller controls the charger to apply charges to a toner image when the toner image is transferred onto a high-smooth sheet having a surface smoothness higher than a surface smoothness of a low-smooth sheet. The controller controls the charger not to apply the charges to the toner image or to apply charges lower than the charges applied in the use of the high-smooth sheet when the toner image is transferred onto the low-smooth sheet.

With such a configuration, the transfer rate of the halftone image relative to the high-smooth sheet can increase even when the intermediate transferor having a relatively lower hardness. Thus, the occurrence of toner scattering of an image to the high-smooth sheet can be prevented.

Next, a description is given of the image forming apparatus according to variation in which a part of the configuration of the image forming apparatus according to the embodiment, Example, the first specific Example, or the second specific Example is replaced with a different configuration. Furthermore, the configuration of an image forming apparatus according to Variation is the same as in the embodiment, Example, or specific Examples unless otherwise stated.

[Variation]

In the image forming apparatus 1000 according to Variation, the input, operation unit 105 does not include the smooth sheet button 501*a* and the uneven sheet button 501*b*. The image forming apparatus 1000 according to Variation is not designed to allow a user to input information regarding the surface smoothness of the recording sheet, instead, the image forming apparatus 1000 according to Variation includes a smoothness sensor to detect the surface smoothness of the recording sheet.

Figure 25:
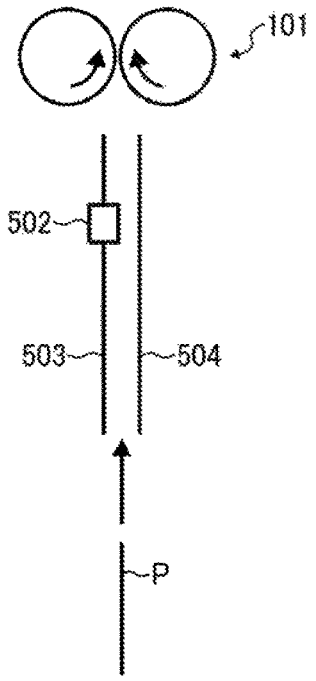
FIG. 25 is a schematic view of a feeding path of the image forming apparatus according to Variation.

FIG. 25 is a schematic view of a feeding path F of the image forming apparatus 1000 according to Variation. The feeding path F guides a recording sheet P interposed between a first guide plate 503 and a second guide plate 504 to a registration nip of the registration rollers 101. The first guide plate 503 includes a through hole in which a smoothness sensor 502 is disposed. The smoothness sensor 502 including a reflective optical sensor emits light emitted from a light emitting element toward a recording sheet P in the feeding path and receives the light totally reflected from the surface of the recording, sheet P at a light receiving element. The amount of totally-reflected light that is obtained by the surface of the smooth sheet, such as a coated sheet is greater than the amount of totally reflected light that is obtained by the surface of the uneven surface sheet, such as Japanese paper.

The smoothness sensor 502 is connected to the power-source controller 200. The power-source controller 200 calibrates the smoothness sensor 502 in a start up of the image fanning apparatus immediately after the main power source of the image forming apparatus is turned on. More specifically, the power-source controller 200 adjusts the amount of light emission (supply voltage) of the light emitting elements to obtain a predetermined amount of totally-reflected light in a suite that the light emitting elements emit light and the emitted light is reflected by the surface of the second guide plate 504 that is white colored. In this case, a supply voltage value is preliminarily stored in a memory. The smoothness sensor 502 supplies a voltage with the same value as the supply voltage value preliminarily stored in the memory to the light emitting elements to detect the amount of totally-reflected light on the surface of the recording sheet P.

When a print job is started, the recording sheet P led out from the sheet tray 100 at a predetermined timing comes in contact with the registration nip of the registration rollers 101 that is not driven, and thereby the conveyance of the sheet is stopped for skew adjustment. In such case, the recording sheet P faces the smoothness sensor 502 in the feeding path F. In this state, the power-source controller 200 causes the smoothness sensor 502 Jo detect the amount of totally-reflected light on the surface of the recording, sheet P. The smoothness sensor 502 is connected to the power-source controller 200. When the detection result exceeds a threshold value, the power-source controller 200 determines that the recording sheet P is a smooth sheet and thereby performs the above-described high-smooth mode. When the detection result tails to exceed the threshold value, the power-source controller 200 determines that the recording sheet P is an uneven surface sheet and thereby performs the above-described low-smooth mode.

In such a configuration, the power-source controller 200 automatically obtains information regarding whether the recording sheet P to be conveyed to the secondary-transfer nip N is the smooth sheet (high-smooth sheet) or the uneven surface sheet (low-smooth sheet) without any operation of a user, thus increasing the operability of users.

When the configuration of the image forming apparatus according to the first specific Example is adopted, the precharge power source 201 outputs the charge bias only in the high-smooth mode. When the configuration of the image forming apparatus according to the second specific Example is adopted, the precharge power source 201 increases the absolute value of the charge bias in the high-smooth mode to be greater than the absolute value of the charge bias in the low-smooth mode.

Figure 26:
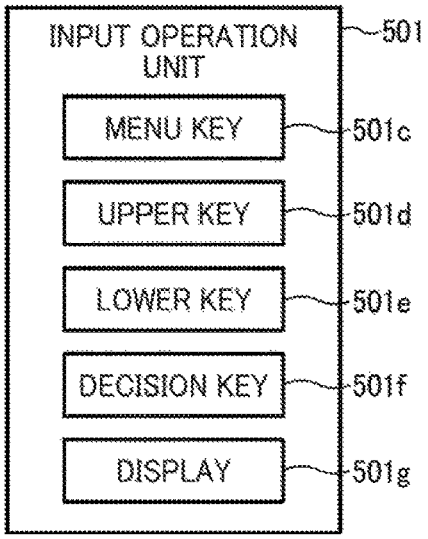
FIG. 26 is a block diagram of electrical circuitry of an input operation unit of the image forming apparatus according to specific Examples.

Next, a description will be given of examples in which a more specific configuration is applied to the image forming apparatus 1000 according to the embodiments, Examples, or specific examples. Furthermore, the configuration of an image forming apparatus according to this example is the same as in the embodiments. Examples, or specific examples unless otherwise stated. FIG. 26 is a block diagram of electrical circuitry of an input operation unit 501 of the linage forming apparatus according to a first Example of the present disclosure. The input operation unit 105 does not include the smooth sheet button 501*a* and the uneven sheet button 501*b* unlike in the embodiments. Examples, and specific examples. Instead, the its put operation unit 105 includes a menu key 501*c*, an upper key 501*d*, a lower key 501*e*, a decision key 501*f*, and a display 501*g*.

When a user presses the menu key 501*c*, the main controller allows the display 501*g* to display a menu screen. The user operates the upper key 501*d* or the lower key 501*e* to align a cursor on a desired menu among a plurality of menus displayed in the menu screen and press the decision key 501*f* so as to select the menu. When the user selects the "Input Type of Sheet" menu through the operation of keys, the main controller allows the display 501*g* to display a list of sheet brands The user may select, through the operation of the tipper key 501*d* and the lower key 501*e*, the same brand as the brand of the recording sheet, that is set in the sheet tray 100 among a plurality of brands included in the list. The brand and the surface smoothness of the recording sheet that belongs to the brand have one-to-one relation, between each other. Thus, the brand serves as information that represents the surface smoothness.

The main controller stores, in a data memory; a data table in which the brands and the numerical values of the opposite-peak duty are associated with each other. The numerical values of the opposite-peak duty that represent high duty are set for the brand of the smooth sheet. The numerical values of the opposite-peak duty that represent low duty are set for the brand of the uneven surface sheet. In terms of the brand of the uneven surface sheet, with an increase in degree of unevenness of the uneven surface sheet, the numerical value of the opposite-peak duty decreases. When the user selects a brand through the operation of the menu, the main controller identifies, from the data table, the numerical value of the opposite-peak duty corresponding to the brand. Then, the main controller sends the result, to the power-source controller 200. The power-source controller 200 having received the numerical value of the opposite-peak duty from the main controller controls the secondary-transfer power source 39 to output the secondary-transfer bias having the same numerical value of the opposite-peak duty as the numerical value sent from the main controller. Accordingly, when the brand of the smooth sheet is selected, the power-source controller 200 performs the high-smooth mode. When the brand of the uneven surface sheet is selected, the power-source controller 200 performs the low-smooth mode.

Such a configuration increases the secondary-transfer efficiency of the halftone image relative to the protrusions of the uneven surface sheet or increases the amount of transfer of toner relative to the recesses of the uneven surface sheet in the low-smooth mode, as compared to the case in which the value of the opposite-peak duty is constant. More specifically, with uneven surface sheet, with a reduction in degree of unevenness of the uneven surface sheet, the area of protrusion increases, thereby increasing the possibility of injecting the charges having the opposite polarity into the few-dot toner masses in the halftone image in the protrusions of the uneven surface sheet. With an increase in degree of unevenness of the uneven surface sheet, the degree (size and depth) of recess in the uneven surface increases, and thereby the transfer failure of toner relative to the recesses of the uneven surface is more likely to occur. To handle such a circumstance, with an increase in degree of unevenness of the uneven surface sheet, the value of the opposite-peak duty is reduced. Tins allows transferring a sufficient amount of toner onto the recesses of the uneven surface sheet having a relatively high degree of unevenness of the uneven surface sheet. In addition, a halftone image is secondarily transferred onto the protrusions of the uneven surface sheet having a relatively low degree of unevenness in the uneven surface sheet in a successful manner.

Note that, the maximum unevenness difference may be used as an index that represents the degree of the sheet surface unevenness. In addition, examples of a commercially available device of the measurement device that measures the degree of unevenness include "SURFCOM 1400D" (manufactured by TOKYO SEIMITSU CO., LTD.). In the measurement device, five sites in the entire region of a surface are randomly selected as a region to be inspected on the basis of an image that is obtained by photographing the surface of a recording sheet with a microscope. With respect to the respective sites, the maximum cross-sectional height (Pt) (JIS B 0601; 2001) of a cross-sectional curve is measured under conditions in which an evaluation length is set to 20 mm and a reference length is set to 20 mm. In addition, an average value of top three heights among five maximum cross-sectional heights Pt, which are obtained, is obtained The above-described processes are performed with respect to each of the front end portion, the central portion, and the rear end portion of the recording sheet P, and an average of respective average values is obtained as the maximum unevenness difference. For example, a recording sheet P of which the maximum unevenness difference (specific information) is 50 μm or greater may be specified as an uneven surface sheet flow-smooth sheet), and a recording, sheet P of which the maximum unevenness difference is less than 50 μm may be specified as a recording sheet having a smooth surface (high-smooth sheet).

When the configuration of the image forming apparatus according to the first specific Example is adopted, the above-described data table in which the brands, the numerical values of the opposite-peak duty, and whether or not the charge bias is output are associated with each other is stored in the data memory. Regarding whether or not the charge bias is output, the affirmative determination for outputting the charge bias is designed to be made according to the brand that corresponds to the smooth sheet, and the negative determination is designed to be made, according to the brand that corresponds to the non-smooth sheet.

When the configuration of the image forming apparatus according to the second specific Example is adopted, the above-described data table in which the brands, the numerical values of the opposite-peak duty, and the values of the charge bias are associated with each other is stored in the data memory. In the data table, the charge bias having an absolute value is associated with the brand corresponding so the smooth sheet, and the charge bias having another absolute value that is lower than the absolute value for the smooth sheet is associated with the brand corresponding to the non-smooth sheet.

The exemplary embodiments described above are one example and attain advantages below in a plurality of aspects A to X.

[Aspect A]

In Aspect A, an image forming apparatus (for example, a printer) includes an image bearer (for example, the intermediate transfer belt 31) to bear a toner image; a nip forming member (for example, the sheet conveyor belt 41) contacting the image bearer to form a transfer nip (for example, the secondary-transfer nip N); a transfer power source (the secondary-transfer power source 30) to output a transfer bias (for example, a secondary-transfer bias) including a superimposed voltage, in which a direct current (DC) voltage and an alternating current (AC) voltage are superimposed on each other, to flow a transfer current (for example, the secondary-transfer current) into the transfer nip to transfer the toner image borne on the image bearer onto a recording sheet disposed between the image bearer and tire nip forming member. The image bearer has a micro-rubber hardness of less than 100. The transfer bias has a transfer-peak value to electrostatically move toner from the image bearer onto the nip forming member in the transfer .nip and an opposite-peak value to electrostatically move less toner from the image bearer to the nip forming member than the transfer peak value. The opposite-peak value is in a side opposite a side of the transfer-peak value. The transfer bias has an opposite-peak duty of less than 50% on the side of the opposite-peak value.

In Aspect A, it is preferable that toner reciprocates in the transfer nip between the image bearer and the recesses of the uneven surface of the recording sheet as many times as needed, e.g., four times of reciprocation so that a sufficient amount of toner can be transferred onto the recesses of the recording sheet having an uneven surface. However, an attempt of achieving the high-speed panting that responds to a demand for business users has difficulties in sufficiently reciprocating toner within the transfer nip. More specifically, such an attempt of the high-speed printing significantly reduces the lime period for toner passing through the transfer nip. To reciprocate toner in the transfer nip at a high speed as many times as needed during such an extremely short passing time period, increasing the peak-to-peak value of the AC voltage of the transfer bias to be a significantly great value frequently causes the electric discharge within the transfer nip The electric discharge further causes a lot of white spots in an image, in view of the above, the AC voltage having a relatively reduced peak-to-peak value is used to prevent or reduce the occurrence of the electric discharge, and the frequency of the AC voltage is significantly increased to reciprocate toner a plurality of times during a short time period. In such a case, the cycle of the transfer bias is significantly shortened, and thereby the polarity of the transfer bias is reversed before toner reaches the destination in the middle of reciprocation. Thus, the minute vibration of toner Sails in the reciprocation of toner.

To handle the above-described circumstances, a flexible image bearer having a micro-rubber hardness of less than 100 is used in Aspect A. Such an image bearer flexibly deforms in conformity with the shape of the uneven surface of the recording sheet within the transfer nip, thereby reducing the distance between the surface of the image bearer and the surface of the bottom of a recess of the recording sheet. More specifically, the transfer bias having an opposite-peak duty of less than 50% is used as the transfer bias in Aspect A. In such a configuration, toner can more successfully reciprocate between the image bearer and the recesses of the uneven surface of the recording sheet with the transfer bias having a smaller peak-to-peak value than the transfer bias having an opposite-peak duty of greater than or equal to 50% does. The configuration according to Aspect A can reciprocate toner within the transfer nip as many times as needed even when the AC voltage having a relatively reduced peak-to-peak value and having a relatively increased frequency is used as the transfer bias. Thus, a sufficient amount of toner can be transferred onto the recesses of the uneven surface of the recording sheet, and the occurrence of white spots in an image can be presented while achieving the high-speed printing.

[Aspect B]

In Aspect B according to Aspect A, the image bearer has a micro-rubber hardness of less than or equal to Such a configuration can reciprocate toner within the transfer nip as many times as needed by using the transfer bias having a relatively reduced peak-to-peak value as is clear from the above-described experiments of the present inventors.

[Aspect C]

In Aspect C according to Aspect B, the image bearer has a micro-rubber hardness of greater than or equal to 36. Such a configuration can prevent the occurrence of the transfer failure of a toner image relative to the recording sheet having a good surface smoothness; as is clear from the above-described experiments of the present inventors.

[Aspect D]

In Aspect D according to any of Aspect A through Aspect B, the image bearer has a multi-layer structure including a base layer and an elastic layer disposed on the base layer. In such a configuration, the image bearer, which includes the elastic layer, can exhibit desired durability and micro-rubber hardness.

[Aspect E]

In Aspect E according to Aspect D, the image bearer has a Martens hardness of less than 240. Such a configuration can achieve a high-speed printing with a flexible image bearer.

[Aspect F]

In Aspect F according to Aspect E, the image bearer has a Martens hardness of less than or equal to 1.1. Such a configuration can reciprocate toner within the transfer nip as many times as needed by using the transfer bias having a relatively reduced peak-to-peak value as is clear from the above-described experiments of the present inventors.

[Aspect G]

In Aspect G according to Aspect F, the image bearer has a Martens hardness of greater than or equal to 0.3. Such a configuration can prevent the occurrence of the transfer failure of a toner image relative to the recording sheet having a good surface smoothness,

[Aspect H]

In Aspect H according to any of Aspect D through Aspect G, the image bearer includes a surface layer disposed on the elastic laser. In such a configuration, the hardness of the elastic layer and the hardness of the surface layer are adjusted, and thereby the image bearer can exhibit desired micro-rubber hardness and Martens hardness. In this configuration, the surface layer is made of material having a good toner separation ability. Accordingly, the secondary transfer rate is enhanced.

[Aspect I]

In Aspect I according to any of Aspect D through Aspect G, the elastic layer is made of resin material including rubber. In such a configuration, the content ratio of rubber to the elastic layer is adjusted, and thereby the image bearer can exhibit desired micro-rubber hardness and Martens hardness.

[Aspect J]

in Aspect J according to any of Aspect D through Aspect G, the elastic layer has a thickness of greater than or equal to 240 μm. In the above-described configuration, the image bearer is designed to have a favorable elasticity, and thereby toner can be successfully transferred onto the recesses of the uneven surface of the recording sheet as is clear from the above-described experiments of the present inventors.

[Aspect K]

In Aspect K according to Aspect J, the elastic layer has a thickness of less than or equal to 390 μm. Such a configuration can prevent the occurrence of the transfer failure of a toiler image relative to the recording sheet having a good surface smoothness due to the image bearer being too soft as is clear from the above-described experiments of the present inventors

[Aspect L]

According to any of Aspect A through Aspect K, the image forming apparatus further includes an information acquisition unit and a controller The information acquisition unit acquires information regarding a surface smoothness of the recording sheet that is a transfer target of the toner image. The controller switches the transfer mode between a high -smooth mode (first mode) to transfer the toner image onto a high-smooth sheet (first type sheet) having a higher surface smoothness than a low-smooth sheet (second type sheet) and a low-smooth mode (second mode) to transfer the toner image onto the low-smooth sheet based on the information acquired by the information acquisition unit. In the low-smooth mode, the controller controls the transfer power source to output the transfer bias having the opposite-peak duty of less than 50% that is a low duty. Such a configuration can successfully transfer a toner image onto the recesses of the uneven surface of the recording sheet, and can also successfully transfer a toner image onto the recording sheet having a good surface smoothness.

[Aspect M]

In Aspect M according to Aspect L, the controller controls the transfer power source to output, the transfer bias that reverses the polarity during one cycle of the AC voltage in the low-smooth mode. Such a configuration can reciprocate toner between the recesses of the uneven surface of the recording sheet and the surface of the image bearer in the transfer nip.

[Aspect N]

In Aspect N according to Aspect M, the controller controls the transfer power source to output the transfer bias having an opposite-peak duty that exceeds 50% that is a high duty in tire high-smooth mode. Such a configuration can successfully transfer a toner image onto a recording sheet having a good surface smoothness as compared to the case in which the transfer bias including only the DC voltage or the transfer bias having the low duty is used in the high-smooth mode.

[Aspect O]

In Aspect O according to Aspect N, the controller controls the transfer power source to output the transfer bias that does not reverse the polarity during one cycle of the AC voltage in the high-smooth mode. Such a configuration can prevent the occurrence of white spots in an image as compared to the case in which the transfer bias that reverses the polarity is used in the high-smooth mode.

[Aspect P]

In Aspect P according to Aspect M the controller controls the transfer power source to output the transfer bins including only the DC voltage in the high-smooth mode. Such a configuration can reduces elect neat toad on the image bearer, thereby increasing the longevity of the image forming apparatus as compared to the case in which the secondary transfer bias including the superimposed voltage is used in the high-smooth mode.

[Aspect Q]

In Aspect Q according to any of Aspect A through Aspect P, a linear velocity of the image bearer exceeds 280 mm/s. Such a configuration can successfully transfer totter onto the recesses of the uneven surface of the recording sheet at an ultra-high speed that exceeds 280 mm/s.

[Aspect R]

In Aspect R according to any of Aspect A through Aspect Q, the image forming apparatus further includes a first image bearer (for example, photoconductors 2Y, 2M, 2C, and 2K) and a charger. The first image bearer bears a toner image on a surface of the first image bearer, and the toner image is to be transferred onto a second image bearer (for example, the intermediate transfer belt 31) as the image bearer. The charger supplies charges having the same polarity as a normal charge polarity of toner to the toner on the first image bearer. In such a configuration, the hardness of the second image bearer is not excessively reduced and the charger supplies charges to the toner on the first image bearer, thus increasing the transfer rate of the halftone image relative to the high-smooth sheet.

[Aspect S]

In Aspect S according to Aspect R, the image forming apparatus further includes an information acquisition unit and a controller. The information acquisition unit acquires information regarding a surface smoothness of the recording sheet that is a transfer target of the toner image. The controller controls a voltage applied to the charger based on the information acquired by the information acquisition unit. Such a configuration can adjust the voltage applied to the charger to have an appropriate value.

[Aspect T]

In Aspect T according to Aspect S, the controller switches the voltage applied to the charger between a high-smooth mode value to transfer the toner image onto the high-smooth sheet having a surface smoothness higher than a surface smoothness of the low-smooth sheet and a low-smooth mode value to transfer the toner image onto the low-smooth sheet, based on the information acquired by the information acquisition unit. Such a configuration can adjust the voltage applied to the charger to have an appropriate value according to each of the high-smooth mode and the low-smooth mode.

[Aspect U]

In Aspect U according to Aspect T, the controller increases the absolute value of the voltage applied to the charger in the high-smooth mode to be greater than the absolute value of the voltage applied to the charger in the low-smooth mode. Such a configuration can present the occurrence of toner scattering due to an undesirable increase in voltage applied to the charger in the low-smooth mode.

[Aspect V]

In Aspect V according to any of Aspect R through Aspect U, the image forming apparatus includes a plurality of first image bearers along a direction of movement on a surface of the second image bearer, and the plurality of first image bearers are disposed side by side in contact with the second image bearer. At least one of the plurality of first image bearers bears a toner image having a smallest toner charge amount after the toner image is transferred onto the second image bearer and before the toner image enter the transfer nip. The charger supplies the charges to toner on the surface of the above-described at least one image bearer. Such a configuration, in which the charger supplies charges to toner, can reliably increase the transfer rate of the halftone image unlike in the configuration that supplies charges to a toner image on the second image bearer as described in the Example.

[Aspect W]

In Aspect W according to any of Aspect R through Aspect U, the image forming apparatus include a plurality of first, image bearers along a direction of movement on a surface of the second image bearer, the plurality of first image bearers being in contact with the second image bearer. At least one of the plurality of first image bearers bears a toner image having a smallest toner charge amount after the toner image is transferred onto the second image bearer and before the toner image enter the transfer nip. The at least one image bearer includes the charger to supply charges to toner on the surface. Such a configuration, in which the charger supplies charges to toner, can reliably increase the transfer rate of the halftone image unlike in the configuration that supplies charges to a toner image on the second image bearer as described in the Example. Further, such a configuration, in which a charger is disposed only in the first image bearer that bears a black loner image of black toner including carbon (C), can prevent the occurrence of transfer failure in the first image bearer in which the transfer failure of the halftone image is most likely to occur among the colors.

[Aspect X]

In Aspect X, an image forming method includes outputting a transfer bias including a superimposed bias, in which a direct current (DC) voltage and an alternating current (AC) voltage are superimposed on each other, from a transfer power source to a transfer nip formed by an image bearer contacting a nip forming member, and transferring a toner image from the image bearer onto a recording sheet disposed between the image bearer and the nip forming member. In this method, the image bearer has a micro-rubber hardness of less than 100. The transfer bias has a transfer-peak value to electrostatically move toner from the image bearer onto the nip forming member in the transfer nip and an opposite-peak value to electrostatically move less toner from the image beater to the nip forming member than the transfer peak value. The opposite-peak value is in a side opposite of a side of the transfer-peak value. The transfer bias has an opposite-peak duty of less than 50% that is a duty on the side of the opposite-peak value.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

an image bearer to bear a toner image, the image bearer having a micro-rubber hardness of less than 100;

a nip forming member contacting the image bearer to form a transfer nip;

a transfer power source to output a transfer bias including a superimposed voltage, in which an alternating current (AC) voltage is superimposed on a direct current (DC) voltage to transfer the toner image borne on the image bearer onto a recording sheet disposed between the image bearer and the nip forming member; and a controller to switch a transfer mode between a first mode to transfer the toner image onto a first type sheet having a surface smoothness higher than a surface smoothness of a second type sheet and a second mode to transfer the toner image onto the second type sheet, the transfer bias having a transfer peak value to electrostatically move toner from the image bearer to the recording sheet and an opposite-peak value to electrostatically move less toner from the image bearer to the recording sheet than the transfer peak value, an opposite-peak duty on a side of the opposite-peak value in the second mode being less than 50%, the opposite-peak duty on the side of the opposite-peak value in the first mode being greater than 50%, and the opposite-peak duty being $tr/T \times 100\%$, where T is one cycle of the transfer bias, and tr is a time period during which the transfer bias is on the side of the opposite-peak value relative to an offset voltage of the transfer bias in T.

2. The image forming apparatus according claim 1, wherein the image bearer has a micro-rubber hardness of less than or equal to 82.

3. The image forming apparatus according to claim 2, wherein the image bearer has a micro-rubber hardness of greater than or equal to 36.

4. The image forming apparatus according to claim 1, wherein the image bearer has a multi-layer structure including a base layer and an elastic layer disposed on the base layer.

5. The image forming apparatus according to claim 4, wherein the image bearer has a Martens hardness of less than 240.

6. The image forming apparatus according to claim 5, wherein the image bearer has a Martens hardness of less than or equal to 1.1.

7. The image forming apparatus according to claim 6, wherein the image bearer has a Martens hardness of greater than or equal to 0.3.

8. The image forming apparatus according to claim 4, wherein the image bearer includes a surface layer disposed on the elastic layer.

9. The image forming apparatus according to claim 4, wherein the elastic layer has a thickness of greater than or equal to 240 μm.

10. The image forming apparatus according to claim 9, wherein the elastic layer has a thickness of less than or equal to 390 μm.

11. The image forming apparatus according to claim 1, further comprising:

circuitry configured to acquire information regarding surface smoothness of the recording sheet that is a transfer target of the toner image; wherein the controller switches the transfer mode between the first mode and the second mode based on the information acquired by the circuitry, the controller to control the transfer power source to output the transfer bias having the opposite-peak duty of less than 50% in the second mode.

12. The image forming apparatus according to claim 11, wherein the controller controls the transfer power source to output the transfer bias that reverses a polarity during one cycle voltage in the second mode.

13. The image forming apparatus according to claim 12, wherein the controller controls the transfer power source to output the transfer bias having the opposite-peak duty that exceeds 50% in the first mode.

14. The image forming apparatus according to claim 13, wherein the controller controls the transfer power source to output the transfer bias that does not reverse the polarity during the one cycle in the first mode.

15. The image forming apparatus according to claim 1, further comprising:

another image bearer to bear a toner image, which is to be transferred onto the image bearer, on a surface of said another image bearer; and a charger to supply charges having a same polarity as a normal charge polarity of toner to the toner on said another image bearer.

16. The image forming apparatus according to claim 15, further comprising:

circuitry configured to acquire information regarding surface smoothness of the recording sheet that is a transfer target of the toner image, wherein the controller is further configured to control a voltage applied to the charger based on the information acquired by the circuitry.

17. The image forming apparatus according to claim 16, wherein the controller switches the voltage applied to the charger between the first mode and the second mode based on the information acquired by the circuitry, and wherein the controller increases an absolute value of the voltage applied to the charger in the first mode to be greater than an absolute value of the voltage applied to the charger in the second mode.

18. The image forming apparatus according to claim 15, further comprising:

a plurality of color image bearers disposed in contact with the image bearer, side by side in a direction of movement on a surface of the image bearer, to bear toner images of different colors, wherein each of the plurality of color image bearers is constituted by said another image bearer, and wherein the charger supplies the charges to only one of the plurality of color image bearers to bear a black toner image.

19. An image forming method comprising:

transferring a toner image from an image bearer having a micro-rubber hardness of less than 100 onto a recording sheet by a transfer bias; and switching a transfer mode between a first mode to transfer the toner image onto a first type sheet having a surface smoothness higher than a surface smoothness of a second type sheet and a second mode to transfer the toner image onto the second type sheet, the transfer bias having a transfer peak value to electrostatically move toner from the image bearer to the recording sheet and an opposite-peak value to electrostatically move less toner from the image bearer to the recording sheet than the transfer peak value, an opposite-peak duty of the opposite-peak value in the second mode being less than 50%, the opposite-peak duty on a side of the opposite-peak value in the first mode being greater than 50%, and the opposite-peak duty being $tr/T \times 100\%$, where T is one cycle of the transfer bias, and tr is a time period during which the transfer bias is on the side of the opposite-peak value relative to an offset voltage of the transfer bias in T.

* * * * *